US009565899B2

(12) United States Patent
Adams et al.

(10) Patent No.: US 9,565,899 B2
(45) **Date of Patent: *Feb. 14, 2017**

(54) SINGLE PULL AND DOUBLE PULL FIT ADJUSTMENT SYSTEM FOR SHOES

(71) Applicants: Thomas M. Adams, San Antonio, TX (US); Andris Kalns, Helotes, TX (US)

(72) Inventors: Thomas M. Adams, San Antonio, TX (US); Andris Kalns, Helotes, TX (US)

(73) Assignee: Fit Squared Shoes, LLC, San Antonio, TX (US)

( * ) Notice: Subject to any disclaimer, the term of this patent is extended or adjusted under 35 U.S.C. 154(b) by 172 days.

This patent is subject to a terminal disclaimer.

(21) Appl. No.: 14/357,539

(22) PCT Filed: Nov. 10, 2012

(86) PCT No.: PCT/US2012/064579

§ 371 (c)(1),
(2) Date: May 9, 2014

(87) PCT Pub. No.: WO2013/071211

PCT Pub. Date: May 16, 2013

(65) Prior Publication Data

US 2014/0338223 A1 Nov. 20, 2014

Related U.S. Application Data

(63) Continuation-in-part of application No. 13/294,173, filed on Nov. 10, 2011, now Pat. No. 9,364,046.

(Continued)

(51) Int. Cl.

*A43C 11/14* (2006.01)
*A43B 3/00* (2006.01)

(Continued)

(52) U.S. Cl.

CPC ..... *A43C 11/14* (2013.01); *A41F 1/008* (2013.01); *A41F 9/002* (2013.01); *A43C 1/00* (2013.01);

(Continued)

(58) Field of Classification Search

CPC ..... A41F 1/008; A41F 9/002; A43C 11/14; A43C 11/1493; A43C 11/008; A43C 1/003; A43C 1/00

(Continued)

(56) References Cited

U.S. PATENT DOCUMENTS 1,197,783 A * 9/1916 Winbray ..... A43C 1/00 36/50.1
1,328,333 A * 1/1920 Mann ..... A43B 3/02 36/50.1

(Continued)

FOREIGN PATENT DOCUMENTS

JP 07-124002 A 5/1995
JP 11-032810 A 2/1999

(Continued)

*Primary Examiner* — Clinton T Ostrup
*Assistant Examiner* — Cameron A Carter
(74) *Attorney, Agent, or Firm* — Kammer Browning PLLC

(57) ABSTRACT

A system for securing shoes to the feet utilizing a one or two pull fit adjustment set of straps. The embodiments utilize a number of straps, some variable in length, positioned at select points across and around the top and sides of the shoe. At least one strap in the system provides an adjustable length whereby all straps may be drawn together to tighten the shoe, preferably in both a horizontal and a vertical direction across the profile of the shoe. The system utilizes a variety of strong, lightweight, nylon buckles, strips, anchor loops, permitting attachment and motion of the adjustment straps over the top and sides of the shoe. Included are three-point attachment embodiments, as well as two-point attachment (Continued)

embodiments, most with a one pull adjustment structure. Most embodiments are on the medial side of the shoe although some may be implemented on the lateral side.

12 Claims, 21 Drawing Sheets

Related U.S. Application Data

(60) Provisional application No. 61/412,199, filed on Nov. 10, 2010.

(51) Int. Cl.
*A43C 11/00* (2006.01)
*A41F 9/00* (2006.01)
*A41F 1/00* (2006.01)
*A43C 1/00* (2006.01)

(52) U.S. Cl.
CPC ..... *A43C 1/003* (2013.01); *A43C 11/008* (2013.01); *A43C 11/1493* (2013.01)

(58) Field of Classification Search
USPC ..... 36/7.1 R, 50.1, 58.5, 114, 138; 602/27
See application file for complete search history.

(56) References Cited

U.S. PATENT DOCUMENTS 2,096,160 A * 10/1937 Chambers ..... A43B 7/1495 36/170
3,703,775 A * 11/1972 Gatti ..... A43B 5/025 36/128
4,079,527 A * 3/1978 Antonious ..... A43C 11/1493 36/50.1
4,282,657 A * 8/1981 Antonious ..... A43B 5/00 24/306
4,308,672 A * 1/1982 Antonious ..... A43C 11/1493 24/306
4,476,639 A * 10/1984 Zaccaria ..... A43B 5/00 36/114
4,513,520 A * 4/1985 Koch ..... A43B 5/0405 36/10
4,547,981 A * 10/1985 Thais ..... A43B 7/00 36/114
4,592,154 A * 6/1986 Oatman ..... A43B 5/00 36/114
4,972,613 A * 11/1990 Loveder ..... A43B 5/00 36/105
5,228,216 A * 7/1993 Sargeant ..... A43B 3/126 36/11.5
5,269,078 A * 12/1993 Cochrane ..... A43B 5/00 36/170
5,408,761 A * 4/1995 Gazzano ..... A43B 5/00 36/102
5,425,185 A * 6/1995 Gansler ..... A43C 11/165 36/50.1
5,463,822 A * 11/1995 Miller ..... A43C 11/00 36/50.1
5,469,640 A * 11/1995 Nichols ..... A43C 1/00 24/306
5,533,277 A * 7/1996 Bell ..... A43C 15/06 36/59 C
5,659,978 A * 8/1997 Bell ..... A43C 15/06 36/11.5
5,659,982 A * 8/1997 Muraoka ..... A43B 3/0073 36/131
5,704,140 A * 1/1998 Fields ..... A43B 7/20 36/132
5,775,006 A * 7/1998 Breuner ..... A43B 3/02 36/45
5,794,360 A * 8/1998 Bell ..... A43C 11/1493 24/306
5,819,439 A * 10/1998 Sanchez ..... A43B 5/00 36/50.1
6,128,835 A * 10/2000 Ritter ..... A43C 1/00 36/114
6,228,043 B1 * 5/2001 Townsend ..... A43B 5/10 36/69
6,286,233 B1 * 9/2001 Gaither ..... A43C 1/00 36/50.1
7,094,213 B1 * 8/2006 Cook ..... A61F 13/066 36/140
7,370,440 B1 * 5/2008 Cole, III ..... A43B 5/003 36/50.1
8,713,820 B2 * 5/2014 Kerns ..... A43B 3/0052 36/50.1
2003/0167655 A1 * 9/2003 Sussmann ..... A43C 11/008 36/50.1
2008/0066344 A1 * 3/2008 Kelley ..... A43C 11/1493 36/50.1
2008/0110050 A1 * 5/2008 Prickell ..... A43C 11/1493 36/50.1
2008/0189987 A1 * 8/2008 Geisser ..... A43C 15/09 36/114
2008/0244928 A1 * 10/2008 Romboli ..... A43C 11/1493 36/50.1
2008/0250667 A1 * 10/2008 Rasmussen ..... A43C 11/008 36/50.1
2009/0090029 A1 * 4/2009 Kishino ..... A43C 11/00 36/116
2009/0272007 A1 * 11/2009 Beers ..... A43B 3/0005 36/50.1
2009/0300947 A1 * 12/2009 Babolat ..... A43B 7/20 36/114
2013/0255105 A1 * 10/2013 Bishop ..... A43B 3/126 36/88

FOREIGN PATENT DOCUMENTS

JP 2004-097498 A 4/2004
KR 10-1996-0700641 A 2/1996

* cited by examiner (Sec. A-A′)

SINGLE PULL AND DOUBLE PULL FIT ADJUSTMENT SYSTEM FOR SHOES

BACKGROUND OF THE INVENTION

1. Field of the Invention

The present invention relates generally to shoes and systems for securing shoes to the feet. The present invention relates more specifically to systems for securing shoes to the feet through the use of a one or two pull fit adjustment set of straps with fixed and floating buckles and loops.

2. Description of the Related Art

Various systems and methods have been traditionally implemented for securing shoes of different types to the feet of the wearer. Most such systems require the use of two hands to adequately secure a shoe to the foot and to adjust the tightness of the secured shoe to an appropriate level. Many individuals, however, find it difficult, if not impossible, to adequately and appropriately secure shoes to their feet with both hands due to their inability to reach the shoe with both hands while it is on the foot. In some instances, individuals may be able to lift one foot and then the other, with the respective shoes in place, onto the opposing knee thereby presenting the medial side of the shoe for access. Even under these conditions, however, it is quite difficult to secure the shoe and adjust its fit with traditional methods of securement, such as shoelaces, or even Velcro® type closures.

While some efforts have been made in the past to utilize hook and loop structures (such as Velcro® straps) to replace shoelace systems, these typically fail to provide adequate and appropriate adjustment of the fit as they are limited to a simple across the top of the foot tightening. It would be desirable to have one or more systems that can adequately and appropriately secure a shoe to the foot and to adjust the fit of the shoe in the process. It would be desirable if such a system need be accessed from only one side of the shoe, preferably the medial side, so as to allow even those users who have difficulty reaching their feet to secure and appropriately adjust a pair of shoes to their feet.

SUMMARY OF THE INVENTION

The present invention provides a number of embodiments within a general system for securing shoes to the feet utilizing a one pull fit adjustment set of straps. The various embodiments each utilize a number of straps, some fixed and some variable in length, positioned at various points across and around the top and sides of the shoe. At least one strap in the system provides an adjustable length (i.e., it may be shortened) whereby all straps may be drawn together to create a fit that tightens the shoe in more than one direction, and preferably in both a horizontal and a vertical direction across the profile of the shoe. The present invention utilizes a variety of strong, but lightweight, nylon buckles, strips, anchor loops, and combinations thereof to permit the attachment and motion of the adjustment straps over the top and sides of the shoe. Included are three-point attachment embodiments as well as two-point attachment embodiments, each with a one pull adjustment structure. Most embodiments are preferably structured on the medial side of the shoe although some may be implemented on the lateral side of the shoe.

DETAILED DESCRIPTION OF THE PREFERRED EMBODIMENTS

Figure 1:
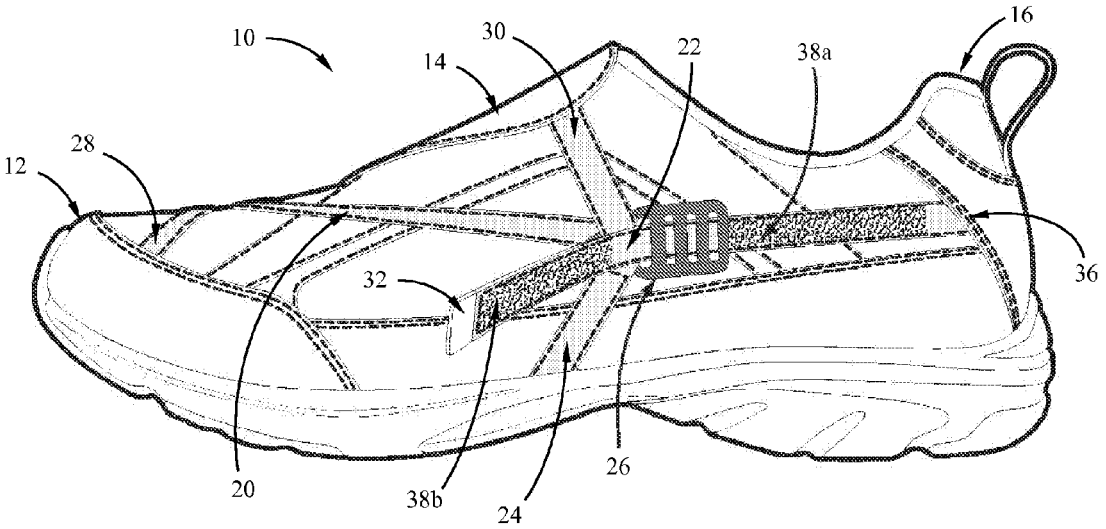
FIG. 1 is a side plan view of the medial side of a shoe incorporating a first preferred embodiment of the present invention utilizing a three fixed attachment point structure, shown with the fit adjustment strap open.
Figure 2:
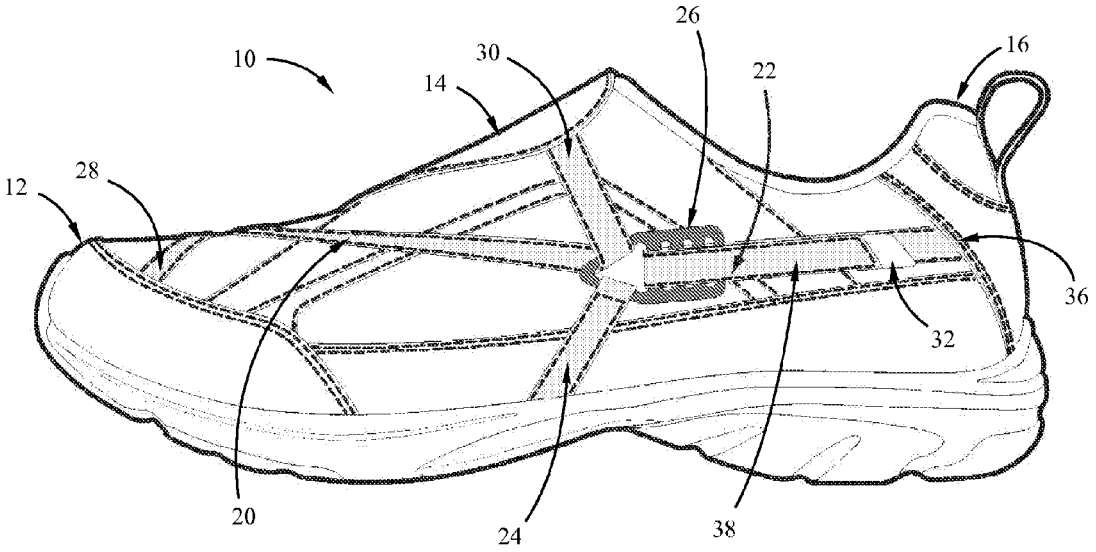
FIG. 2 is a side plan view of the medial side of the shoe shown in FIG. 1 incorporating the first preferred embodiment of the present invention utilizing a three fixed attachment point structure, shown with the fit adjustment strap closed.

FIG. 1 is a side plan view of the medial side of a shoe incorporating a first preferred embodiment of the present invention utilizing a three fixed attachment point structure, shown with the fit adjustment strap open. FIG. 1, representing the first preferred embodiment of the present invention, utilizes a three fixed point attachment structure. FIG. 1 shows this system in the open condition, while FIG. 2 shows the system tightened and closed. In FIG. 1, fit adjustment shoe 10 is shown to include shoe toe region 12, shoe upper 14, and shoe heel region 16. Forward adjustment strap 20 is positioned as shown, extending across the top front of the shoe from forward strap toe region attachment point 28. Forward adjustment strap 20 extends through the triangular aperture of tri-buckle/adjustment strip 26 and then up to a second fixed point of attachment at forward strap top region attachment point 30. Forward adjustment strap 20 extends through a forward strap mid-anchor loop (not shown) in a manner described below in FIG. 3A. Although fixed at each end, forward adjustment strap 20 is loosely stretched across the outward surfaces of the shoe and may slide across these surfaces as it is drawn backward in the manner described below.

Lower adjustment strap 24 is a short length of strap that extends up from the sole of the shoe through tri-buckle/adjustment strip 26 and then back down to the sole of the shoe in a fixed length manner whereby the strap may be sewn back on itself. Rear adjustment strap 22 extends from rear strap fixed attachment point 36 on shoe heel region 16. Rear adjustment strap 22 extends forward to a point where fit strap end tab 32 may be inserted through one of the plurality of apertures in tri-buckle/adjustment strip 26. Essentially, this first embodiment of the present invention positions the adjustment strip at the medial side mid-point, and combines an adjustment strip with a tri-buckle (triangular) component.

FIG. 2 is a is a side plan view of the medial side of a shoe incorporating the first preferred embodiment of the present invention utilizing a three fixed attachment point structure, in this case shown with the fit adjustment strap closed. The manner of adjusting the fit of the shoe in the first preferred embodiment involves threading the fit strap end tab 32 through tri-buckle/adjustment strip 26 and one of the apertures shown (see FIG. 1) and then directing rear adjustment strap 22 back onto itself, such that hook and loop fastening surfaces 38*a* and 38*b* may be aligned and connected. Prior to making contact between hook and loop fastening surfaces 38*a* and 38*b*, the user may draw the rear adjustment strap 22 tightly backwards towards the heel region of the shoe, thereby drawing and tightening the forward adjustment strap and the lower adjustment strap. In this manner, and according to the structure of the shoe as shown in FIGS. 1 and 2, the user may tighten the shoe around the foot, both horizontally and vertically, so as to achieve a secure fit.

Figure 3A:
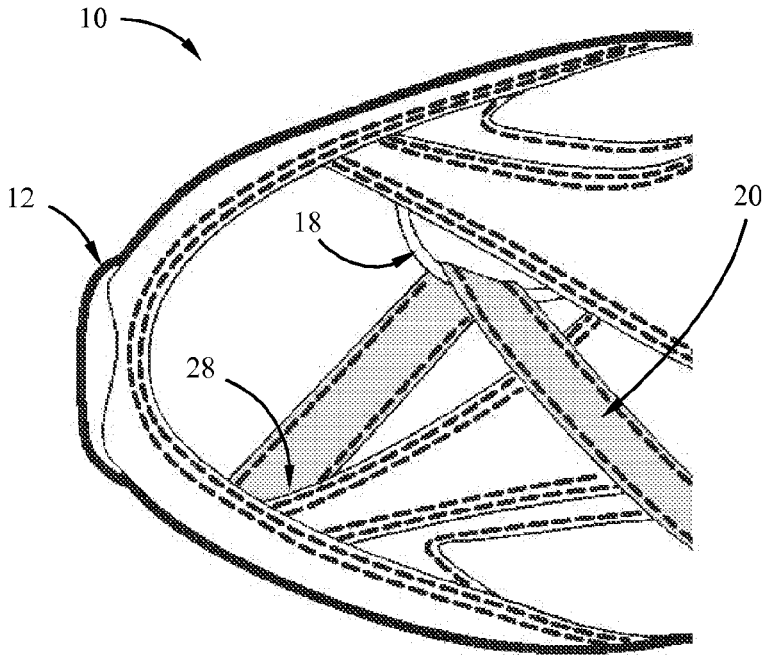
FIG. 3A is a detailed top plan view of the shoe shown in FIG. 1 incorporating the first preferred embodiment of the present invention showing the extended eye stay mid-anchor loop component positioned on the top of the toe region of the shoe.
Figure 3B:
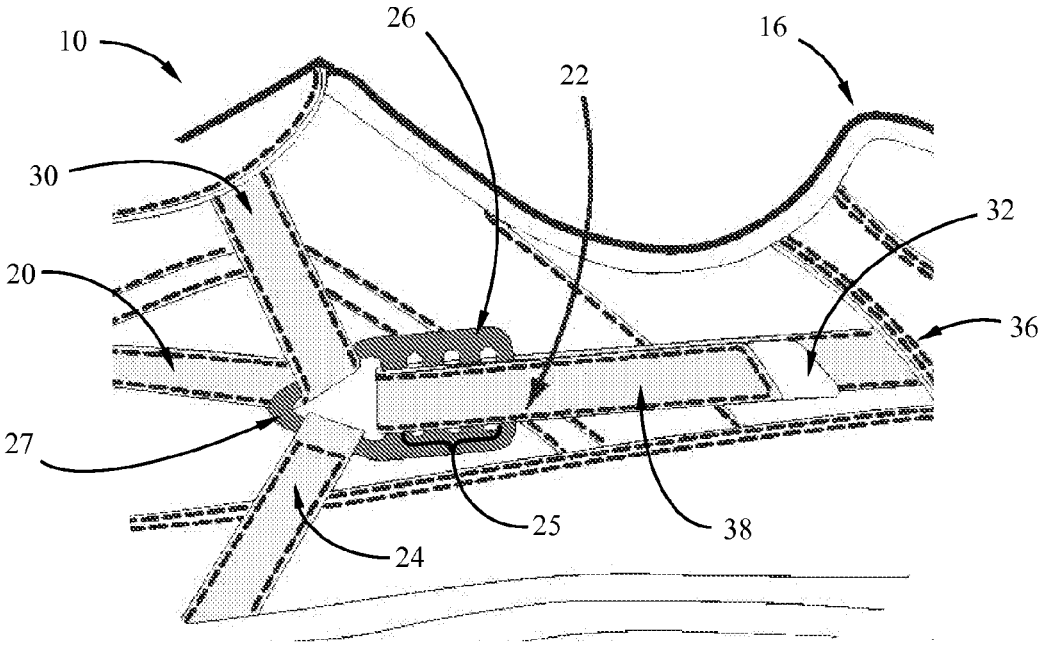
FIG. 3B is a detailed side plan view of the shoe shown in FIG. 1 incorporating the first preferred embodiment of the present invention showing the mid-shoe floating tri-buckle/adjustment strip component positioned at a central point on the medial side of the shoe.

FIG. 3A is a detailed top plan view of the shoe shown in FIG. 1 incorporating the first preferred embodiment of the present invention showing the extended eye stay mid-anchor loop component positioned on the top of the toe region of the shoe. FIG. 3B is a detailed side plan view of the shoe shown in FIG. 1 incorporating the first preferred embodiment of the present invention showing the floating tri-buckle/adjustment strip component positioned at a central point on the medial side of the shoe.

In FIG. 3A, fit adjustment shoe 10 is shown in greater detail around shoe toe region 12 wherein forward strap mid-anchor loop 18 is positioned to hold and re-direct forward adjustment strap 20 as shown. Forward adjustment strap 20 is secured as described above at forward strap attachment point 28 between the layers of fit adjustment shoe 10 near the shoe toe region 12. Forward adjustment strap 20 is then directed loosely across shoe toe region 12 to forward strap mid-anchor loop 18. After passing loosely through forward strap min-anchor loop 18, forward adjustment strap 20 extends across and back over the medial side of fit adjustment shoe 10 towards its sliding connection to tri-buckle/adjustment strip 26 (shown in FIG. 1 and in FIG. 3B).

FIG. 3B is a detailed side plan view of the tri-buckle/adjustment strip component 26 centrally positioned and floating on the medial side of the shoe 10. As referenced above, rear adjustment strap 22 extends from its fixed attachment point 36 on shoe heel region 16 along the medial side of fit adjustment shoe 10 to a point near tri-buckle/adjustment strip 26. Tri-buckle/adjustment strip 26 incorporates a plurality of adjustment strip apertures 25 in addition to its triangular aperture. In the embodiment shown in FIGS. 1 and 2, and as shown in detail in FIG. 3B, tri-buckle/adjustment strip 26 incorporates three spaced apertures 25 into one of which fit strap end tab 32 may be placed from behind. In the detailed drawing in FIG. 3B, fit strap end tab 32 is shown to be fed through the triangular aperture instead of one of apertures 25 in tri-buckle/adjustment strip 26, again from the back side of the buckle towards the front, where rear adjustment strap 22 is then turned back on itself so that hook and loop fastening surfaces 38 are placed together for secure attachment. The wearer may tighten the shoe by separating hook and loop fastening surfaces 38 and pulling on the fit strap end tab 32 outward and rearward so as to draw not only the shoe heel region 16 forward, but to likewise to draw together the remaining adjustment straps 20 and 24 of the system of the present invention as described above.

Figure 4:
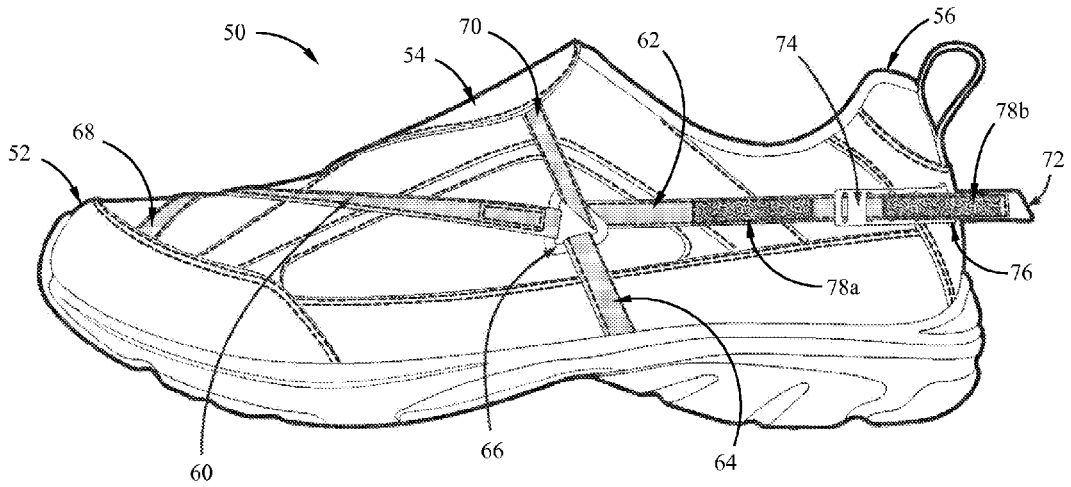
FIG. 4 is a side plan view of the medial side of a shoe incorporating a second preferred embodiment of the present invention utilizing a three fixed attachment point structure, shown with the fit adjustment strap open.
Figure 5:
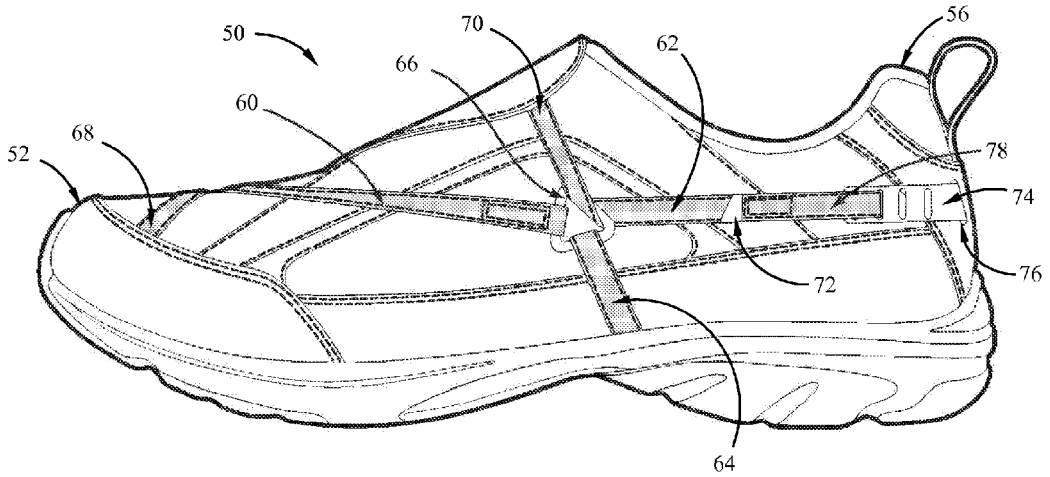
FIG. 5 is a side plan view of the medial side of the shoe shown in FIG. 4 incorporating the second preferred embodiment of the present invention utilizing a three fixed attachment point structure, shown with the fit adjustment strap closed.

FIGS. 4 & 5 represent a second embodiment of the present invention incorporating a three-point fixed attachment structure with a single pull fit adjustment set of straps serving to secure the shoe to the foot. A key element in this second embodiment of the present invention is a simple floating tri-buckle configured and positioned near the center of the medial side profile of the shoe.

In FIG. 4, fit adjustment shoe 50 is shown to comprise shoe toe region 52, shoe upper 54, and shoe heel region 56. This embodiment of the system of the present invention generally includes forward adjustment strap 60, rear adjustment strap 62, and lower adjustment strap 64. These adjustment straps are joined one to another through tri-buckle 66 positioned as shown near the center of the medial side profile of fit adjustment shoe 50. Forward adjustment strap 60 is secured at a first end at forward strap attachment point 68 wherein the end of the strap may be fixed within the sewn seams and layered material of the shoe toe region 52. The manner in which forward adjustment strap 60 then extends across the top of the shoe toe region 52 and back toward tri-buckle 66, is described in more detail above with the first embodiment. Forward adjustment strap 60 terminates at an end opposite from forward strap attachment point 68 by being looped through tri-buckle 66 and then secured back on itself by a sewn seam or other means of attachment.

Lower adjustment strap 64 is a short length of the strap extending from a fixed point where it is secured between the upper of the shoe and the sole of the shoe, up to a point looped around tri-buckle 66. In a preferred embodiment lower adjustment strap 64 may simply be a double length of strap, both ends of which are secured between the upper of the shoe and the sole of the shoe, and which loop around tri-buckle 66 as shown, the strap preferably being sewn back on itself.

Rear adjustment strap 62 is fixed at a first end at rear strap fixed attachment point 70 on a sliding part of the shoe upper. Rear adjustment strap 62 then extends through tri-buckle 66 at an angle towards the heel region 56 of the shoe where it terminates at fit strap end tab 72. Rear adjustment strap 62 passes through one of the apertures positioned in rear adjustment strip (buckle) 74. This arrangement is shown in its open condition in FIG. 4 and its closed condition in FIG. 5. Fit strap end tap 72 is a semi-rigid component fixed to the end of flexible rear adjustment strap 62 to facilitate the insertion of the end of rear adjustment strap 62 through the apertures in rear adjustment strip (buckle) 74, again as shown. Rear adjustment strip (buckle) 74 is fixed in position on the fit adjustment shoe 50 at rear buckle fixed attachment point 76. Rear adjustment strip (buckle) 74 may be a semi-rigid plastic or nylon buckle that is integrated at one end into the layers of the fit adjustment shoe 50 in the shoe heel region 56. The unsecured end of rear adjustment strip (buckle) 74 is available to receive fit strap end tab 72 through one of its apertures as described above.

Rear adjustment strap 62, after passing through rear adjustment strip (buckle) 74 folds back on itself so as to be secured through the mating of opposing hook and loop fastening surfaces 78*a* and 78*b* as shown in FIG. 4. FIG. 5 shows the hook and loop fastening surfaces 78 positioned together in a secure manner.

The user may place the shoe on the foot with the adjustment system shown in its open condition as in FIG. 4. Once the shoe is on the user's foot, the fit strap end tab 72 may be passed through the appropriate aperture of rear adjustment strip (buckle) 74 and then pulled tight by the wearer horizontally towards the toe region 52 of the shoe thereby tightening all of the various adjustment straps positioned on the shoe centrally gathered at the tri-buckle 66. The structure of the system allows a single pull on the rear adjustment strap to draw both the top of the shoe down towards the sole (a vertical tightening) as well as the toe region of the shoe across and back. In addition, the heel region of the shoe is drawn towards the toe region to a point central to the medial side profile of the shoe, again as described above.

FIG. 5 is a side plan view of the medial side of a shoe incorporating the second preferred embodiment of the present invention utilizing a three fixed attachment point structure, shown with the fit adjustment strap closed.

Figure 6:
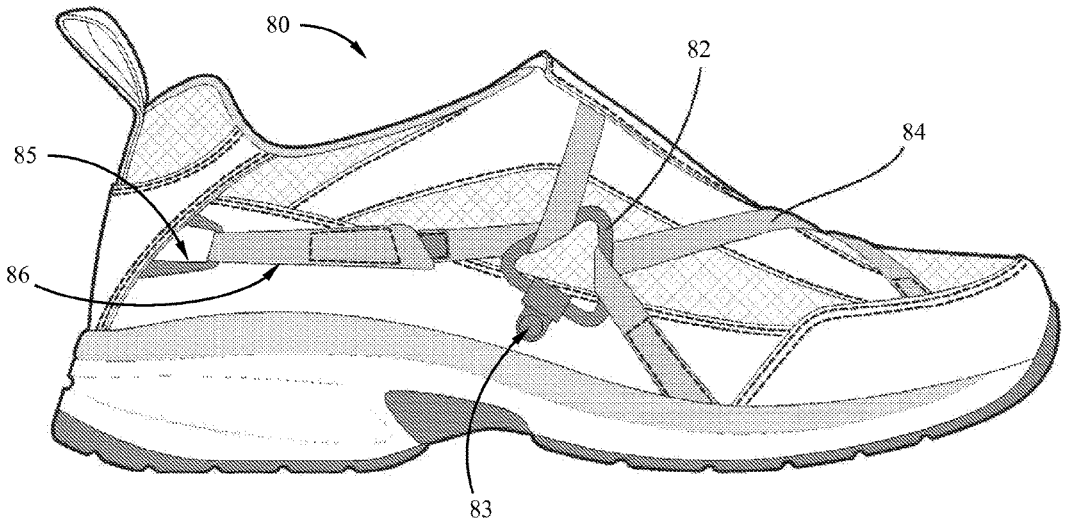
FIG. 6 is a side plan view of the medial side of a shoe incorporating a third preferred embodiment of the present invention utilizing a three fixed attachment point structure, shown with the fit adjustment strap closed.
Figure 7:
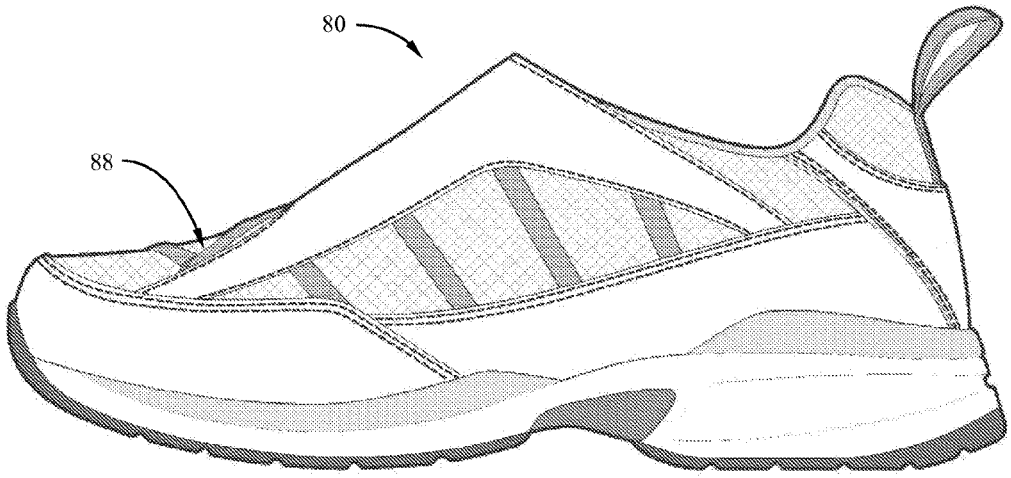
FIG. 7 is a side plan view of the lateral side of the shoe shown in FIG. 6 incorporating the third preferred embodiment of the present invention utilizing a three fixed attachment point structure.

FIGS. 6 and 7 describe a third preferred embodiment of the present invention, once again utilizing three fixed points of attachment across the medial side of the shoe. FIG. 6 is a side plan view of the medial side of a shoe 80 incorporating a third preferred embodiment of the present invention utilizing a three fixed attachment point structure, shown with the fit adjustment strap closed. FIG. 7 is a side plan view of the lateral side of the shoe shown in FIG. 6 incorporating the third preferred embodiment of the present invention utilizing a three fixed attachment point structure. Similar in many respects to the second preferred embodiment described above, the embodiment of FIGS. 6 and 7 utilizes a fixed tri-buckle 82 to provide the center of draw tension for forward adjustment strap 84 and rear adjustment strap 86. Tri-buckle 82 is fixed (not floating) to the side of shoe 80 with low profile rivet 83.

Forward adjustment strap 84 is retained in much the same manner as that of the second preferred embodiment described above, except for its second attachment point extending downward to a fixed point of attachment at the sole of the shoe rather than extending up to the upper of the shoe. In this embodiment, the top portion (tongue area) of the shoe is secured at a fixed attachment point with rear adjustment strap 86 which extends down through tri-buckle 82 and back to a rear strap mid-anchor loop 85. The manner of tightening and securing the system of this third preferred embodiment is similar to that described in the second preferred embodiment wherein the rear adjustment strap is directed through mid-anchor loop 85 and forward where it is pulled tight and attached back on itself with matching hook and loop surfaces. Mid-anchor loop 88 shown in FIG. 7 functions in the same manner as in the first and second embodiments described above.

Figure 8:
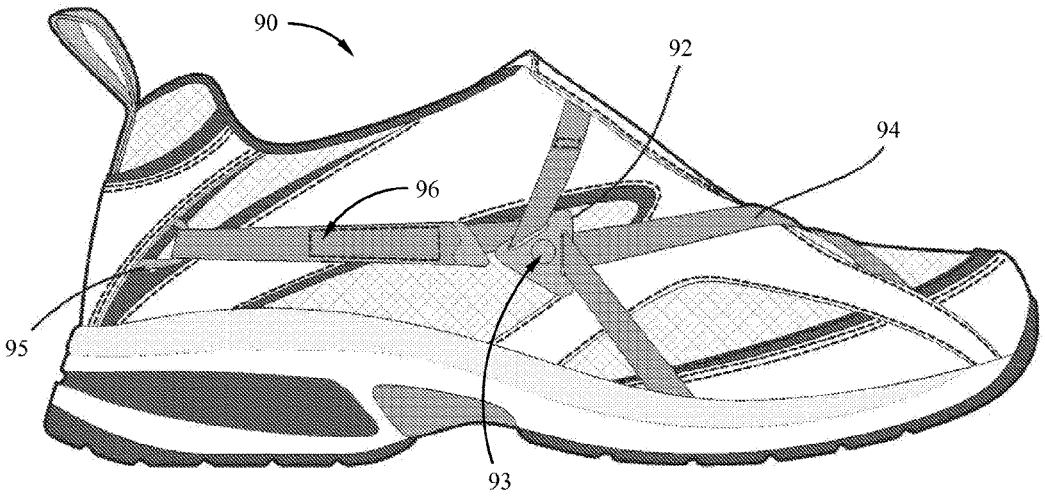
FIG. 8 is a side plan view of the medial side of a shoe incorporating a fourth preferred embodiment of the present invention utilizing a three fixed attachment point structure, shown with the fit adjustment strap closed.
Figure 9:
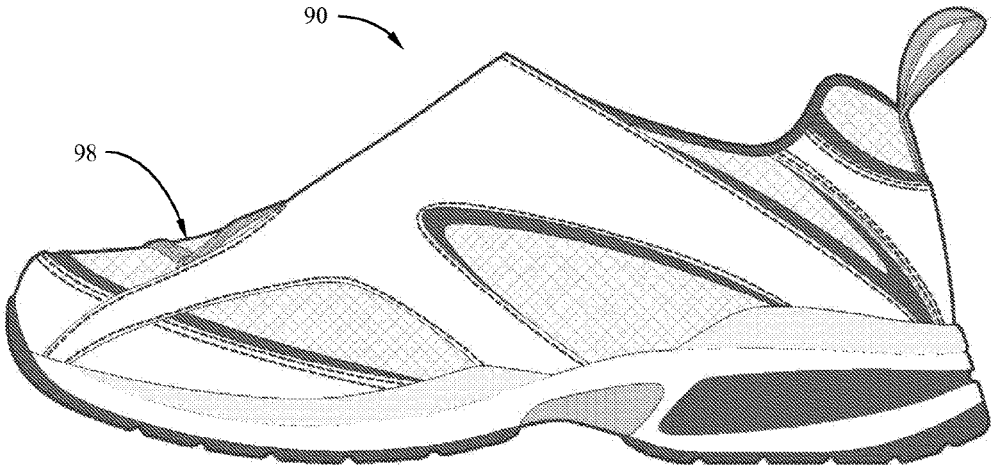
FIG. 9 is a side plan view of the lateral side of the shoe shown in FIG. 8 incorporating the fourth preferred embodiment of the present invention utilizing a three fixed attachment point structure.

A fourth preferred embodiment is shown in FIGS. 8 and 9 which describe a system similar in most respects to the third preferred embodiment shown in FIGS. 6 and 7 with the exception of the structure of molded nylon tri-buckle 92. FIG. 8 is a side plan view of the medial side of a shoe incorporating a fourth preferred embodiment of the present invention utilizing a three fixed attachment point structure, shown with the fit adjustment strap closed. FIG. 9 is a side plan view of the lateral side of the shoe shown in FIG. 8 incorporating the fourth preferred embodiment of the present invention utilizing a three fixed attachment point structure. In order to avoid a fixed attachment, such as with tri-buckle 82 (shown in FIG. 6), tri-buckle 92 shown in FIG. 8 floats on the surface of the shoe, and may therefore be drawn more easily in a horizontal direction by tightening and securing the respective straps.

Figure 10:
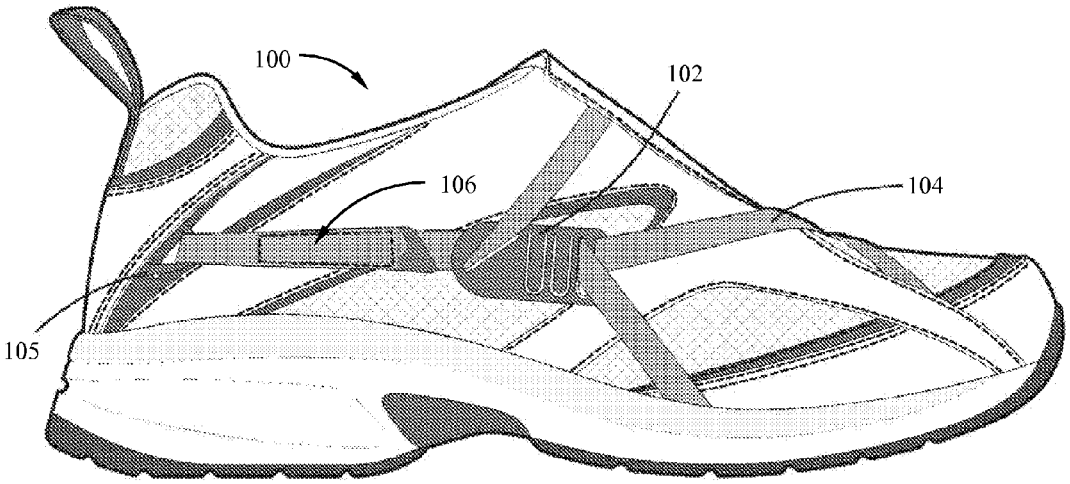
FIG. 10 is a side plan view of the medial side of a shoe incorporating a fifth preferred embodiment of the present invention utilizing a three fixed attachment point structure, shown with the fit adjustment strap closed.
Figure 11:
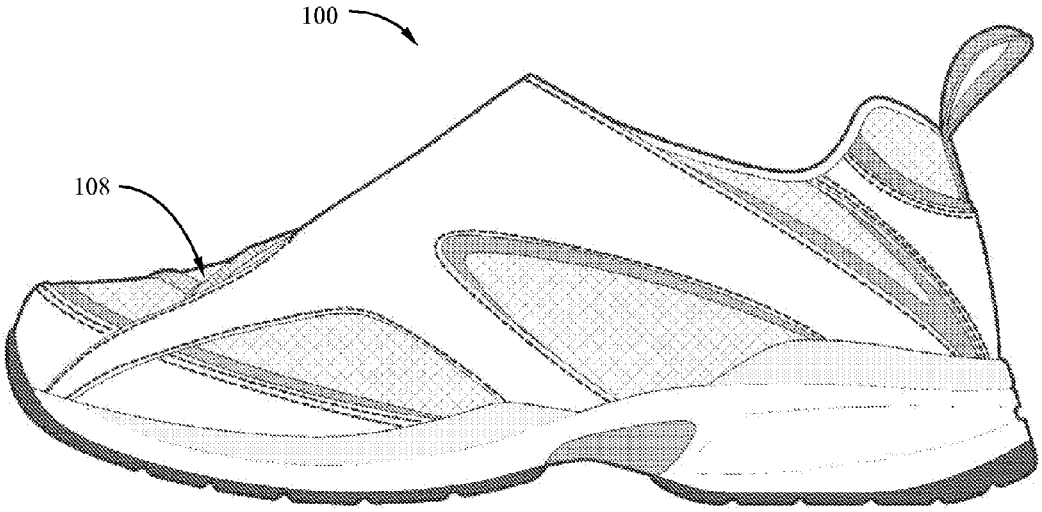
FIG. 11 is a side plan view of the lateral side of the shoe shown in FIG. 10 incorporating the fifth preferred embodiment of the present invention utilizing a three fixed attachment point structure.

Reference is next made to FIGS. 10 and 11 for a fifth preferred embodiment of the present invention wherein the tri-buckle structure is replaced with a molded nylon adjustment bar 102. FIG. 10 is a side plan view of the medial side of a shoe incorporating a fifth preferred embodiment of the present invention utilizing a three fixed attachment point structure, shown with the fit adjustment strap closed. FIG. 11 is a side plan view of the lateral side of the shoe shown in FIG. 10 incorporating the fifth preferred embodiment of the present invention utilizing a three fixed attachment point structure. Again, similar in many respects to the third preferred embodiment described above, fit adjustment shoe 100 in FIG. 10 incorporates forward adjustment strap 104 which extends slidingly through molded nylon adjustment bar 102. Rear adjustment strap 106 extends from a fixed point at the top of the upper of the shoe (tongue region) through an angled aperture in molded nylon adjustment bar 102 back to the heel region of the shoe through mid-anchor loop 105 fixed on the heel region of the shoe. The unique structure of molded nylon adjustment bar 102 allows for variations in the connection to forward adjustment strap 104 by looping forward adjustment strap 104 over one of a plurality of fingers positioned on semi-rigid molded nylon adjustment bar 102.

Figure 12A:
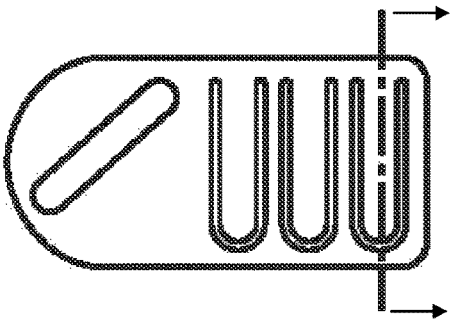
FIGS. 12A-12D are detailed side plan views and an end plan view of two variations of the adjustment bar component of the fifth preferred embodiment of the present invention.
Figure 12B:
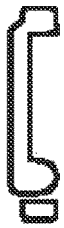

Variations on the structure of molded nylon adjustment bar 102 are shown in FIGS. 12A-12D. FIGS. 12A and 12B show a side plan view and a cross-sectional view of the structure shown in FIG. 10, which provides an angled aperture for reception of the rear adjustment strap 106 and a plurality of open finger apertures, each defining a strap width channel (see FIG. 12B cross-section) to removably retain forward adjustment strap 104. Forward adjustment strap 104 may then be selectively placed in any of the plurality of adjustment locations defined by the attachment bars.

Figure 12C:
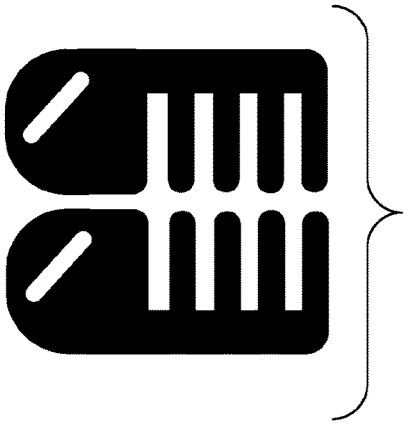
Figure 12D:
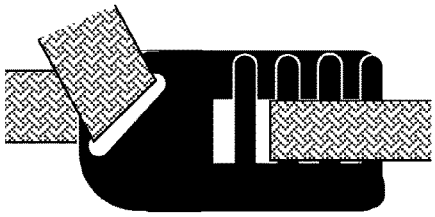

FIGS. 12C and 12D described an alternate embodiment wherein overlapping plates may be used to establish multiple apertures through which forward adjustment strap 104 may be placed. In this embodiment, which is fixed to rear adjustment strap 106 as shown in FIG. 10, the user may separate the overlapping plates to insert the forward adjustment strap loop into the appropriate slot, and then allow the straps to draw the plates together and retain them in position while in use.

Figure 13:
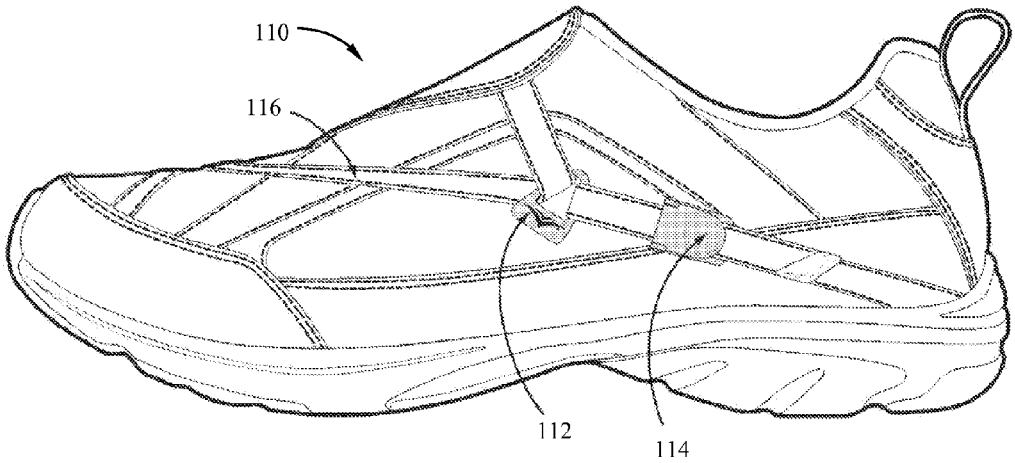
FIG. 13 is a side plan view of the medial side of a shoe incorporating a sixth preferred embodiment of the present invention utilizing a two fixed attachment point structure, shown with the fit adjustment strap closed.

Reference is next made to FIG. 13 for a sixth preferred embodiment of the present invention utilizing a two fixed attachment point structure. FIG. 13 is a side plan view of the medial side of a shoe incorporating a sixth preferred embodiment of the present invention utilizing a two fixed attachment point structure, shown with the fit adjustment strap closed. In FIG. 13 the system is shown with a fit adjustment strap closed back onto itself towards the lower heel portion of the shoe. This sixth embodiment utilizes a molded nylon slide connector 112 which retains and allows forward adjustment strap 116 to move and tighten easily as described in the previous embodiments. Instead of hook and loop closure, however, this embodiment utilizes a locking molded nylon strap closure 114 positioned on rear adjustment strap as shown. The user may draw rear adjustment strap tight as described above, and then close and lock molded nylon strap closure 114 to secure rear adjustment strap in place. Loosening the system involves lifting the end tab of rear adjustment strap outward to open locking molded nylon strap closure 114 and release the rear adjustment strap from its frictional securement within the closure.

Figure 14:
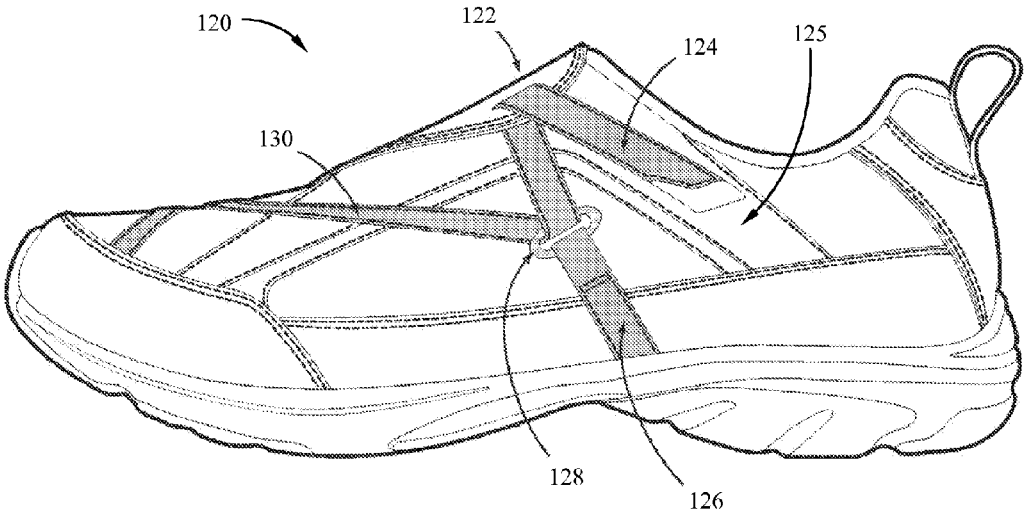
FIG. 14 is a side plan view of the medial side of a shoe incorporating a seventh preferred embodiment of the present invention utilizing a two fixed attachment point structure, shown with the fit adjustment strap closed.

FIG. 14 describes the seventh preferred embodiment of the present invention, again utilizing only a two fixed attachment point structure. FIG. 14 is a side plan view of the medial side of a shoe incorporating a seventh preferred embodiment of the present invention utilizing a two fixed attachment point structure, shown with the fit adjustment strap closed. In this view, forward adjustment strap 130 is fed through a nylon slide connector 128 which, on an opposing side receives and retains a loop from stretch elastic strap 126. Forward adjustment strap 130 then extends upward from nylon slide connector 128 to an overlay flap with strap apertures 122 (one of which can be seen in FIG. 14) where it is then directed back and over the medial side of the shoe to a point where it is secured to the side of the shoe with hook and loop strap closure 124. In this instance, rather than turning back on itself, the strap closure is attached to a surface on the shoe 120 comprised of the loop component (the softer component) of a hook and loop combination of surfaces.

Figure 15:
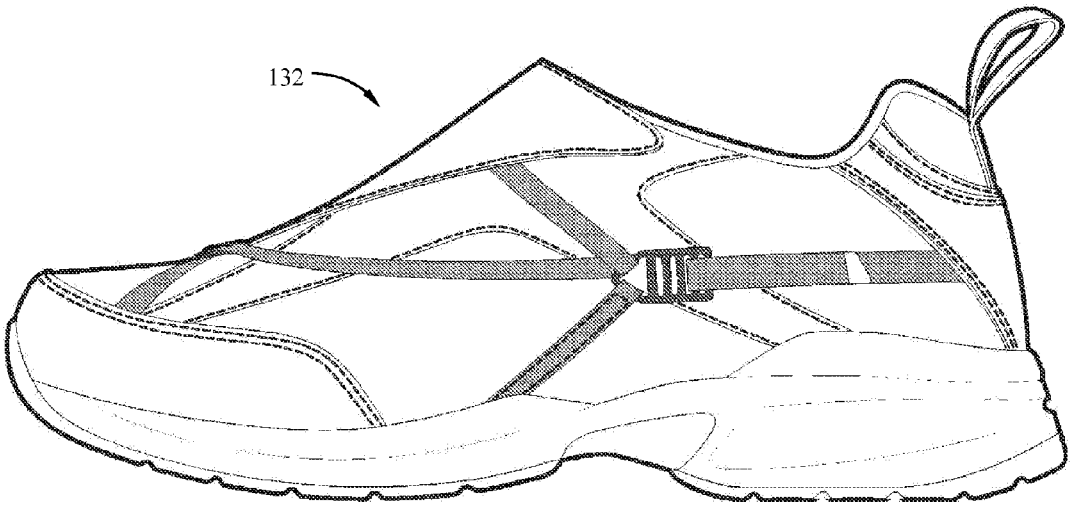
FIG. 15 is a side plan view of the lateral side of a shoe incorporating an eighth preferred embodiment of the present invention utilizing a three fixed attachment point structure, shown with the fit adjustment strap closed.
Figure 16:
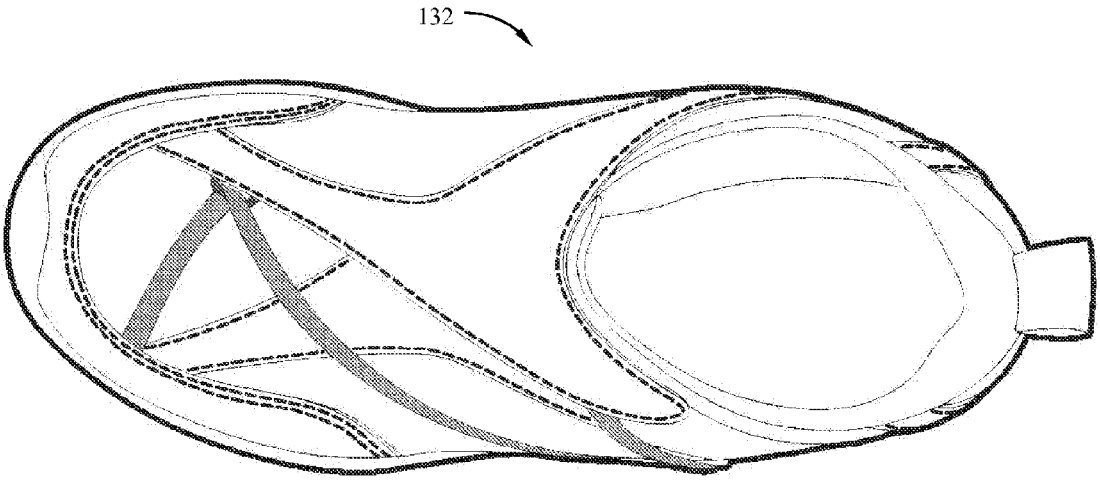
FIG. 16 is a top plan view of the shoe shown in FIG. 15 incorporating the eighth preferred embodiment of the present invention utilizing a three fixed attachment point structure.

Reference is next made to FIGS. 15 & 16 for an eighth preferred embodiment of the present invention representing placement of the system of the present invention on the lateral side of the shoe. FIG. 15 is a side plan view of the lateral side of fit adjustment shoe 132 incorporating an eighth preferred embodiment of the present invention utilizing a three fixed attachment point structure, shown with the fit adjustment strap closed. FIG. 16 is a top plan view of fit adjustment shoe 132 shown in FIG. 15 incorporating the eighth preferred embodiment of the present invention utilizing a three fixed attachment point structure. FIG. 15 shows the lateral side profile view of the shoe, while FIG. 16 shows the top view.

In contrast to the above preferred embodiments, this eighth preferred embodiment may be adjusted and secured by the user by reaching down to the side of the foot on the lateral side of the shoe. This eighth preferred embodiment utilizes a molded nylon adjustment bar similar to that shown in connection with the first preferred embodiment in FIGS. 1 and 2. This adjustment bar secures the lateral side of the shoe in a manner similar to which the system of the first preferred embodiment described above secures the medial side of the shoe. The same functional components are re-positioned on the lateral side of the shoe in a manner that allows operation of the system from that side rather than the medial side.

Figure 17:
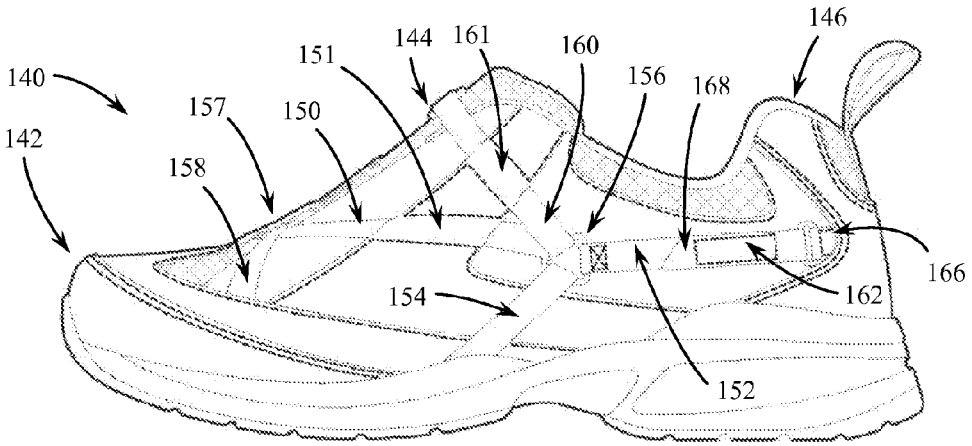
FIG. 17 is a side plan view of the lateral side of a shoe incorporating a ninth preferred embodiment of the present invention utilizing a double pull system with a two by four fixed attachment point structure.
Figure 18:
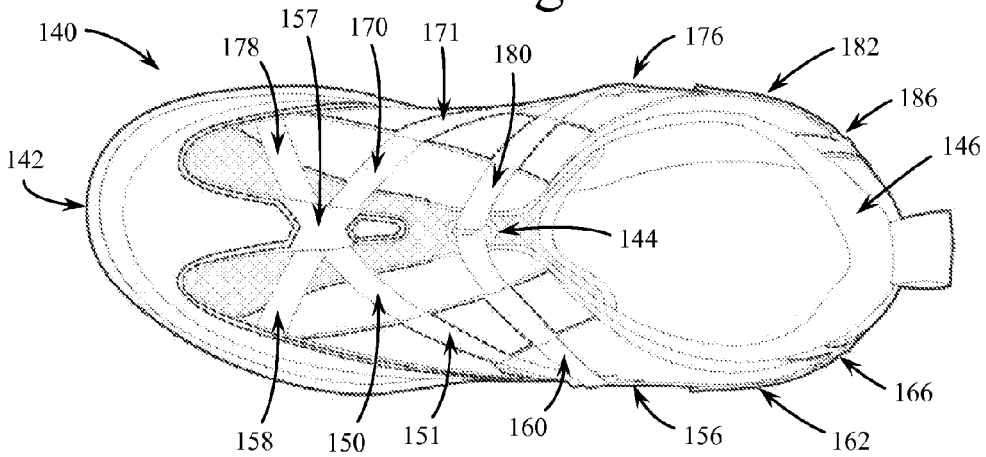
FIG. 18 is a top plan view of the shoe shown in FIG. 18 incorporating the ninth preferred embodiment of the present invention utilizing a double pull system with a two by four fixed attachment point structure.
Figure 19:
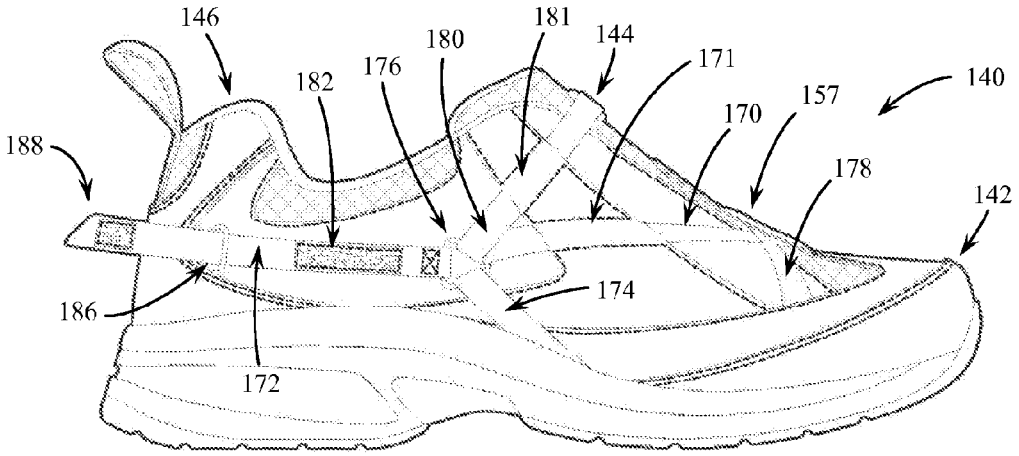
FIG. 19 is a side plan view of the medial side of the shoe shown in FIG. 18 incorporating the ninth preferred embodiment of the present invention utilizing a double pull system with a two by four fixed attachment point structure.

Reference is next made to FIGS. 17-19 for a description of a ninth preferred embodiment of the present invention utilizing a double-pull system with a two by four fixed attachment point structure. The double-pull system shown provides a means for tightening the shoe on either or both of the medial and lateral sides. In fulfillment of the objectives of the present invention, the lateral side of the shoe may be initially adjusted and then may remain in fixed adjustment while the user loosens and tightens the shoe through the medial adjustment means. Alternately, the user may adjust both sides of the shoe with each use of the shoe, fitting it to the foot in a customized manner each time.

FIG. 17 is a side plan view of the lateral side of a shoe incorporating the ninth preferred embodiment structures. Fit adjustment shoe 140 is shown to include toe region 142 and shoe heel region 146. Forward adjustment strap 150 is positioned as shown extending across the top front of the shoe from forward strap toe region attachment point 178 (not seen in FIG. 17 but visible in FIGS. 18 & 19). Forward adjustment strap 150 extends through the triangular aperture of tri-buckle component 156 and then up to a fixed ring point of attachment at forward strap top attachment ring 144. Forward adjustment strap 150 extends through a flexible retention channel 157 which positions and retains the cross-over of the two forward straps as seen most clearly in FIG. 18 as described below.

Fixed strap 154 extends from a position incorporated in the sole of the shoe up to tri-buckle component 156. An adjustable strap component 152 extends from a fixed position on tri-buckle component 156 slidingly through a fixed retention ring 166 where strap end 168 is folded back on itself towards the tri-buckle component 156, adhering onto itself with a set of hook and loop attachment surfaces 162.

The strap crossover structure of the ninth preferred embodiment shown in FIGS. 17-19 allows for a symmetrical tightening of the upper of the shoe through the use of the dual pull system. As shown in FIG. 18, a single strap crosses over the top of the shoe from the medial side to the lateral and a second strap crosses from the lateral to the medial side before returning to a center point over the top portion of the shoe near the tongue of the shoe. Strap component 170 therefore extends from its point of attachment 158 on the lateral side of the shoe through the retention channel 157 to the medial side of the shoe where it passes through retention channel 171 to a point where it loops through tri-buckle component 176. The same strap then returns upward as strap component 180 through retention channel 181 to a point of attachment at the top of the shoe at forward strap top attachment ring 144. The same structure is incorporated into a mirror image on the opposite side of the shoe whereby strap component 150 extends through retention channel 157 and then extends through retention channel 151 after which it passes through tri-buckle component 156 before returning through retention channel 161 to the high point on the shoe where it is fixed at component 144. In other words, the structure shown in FIG. 17 for the lateral side of the shoe has mirror image components shown in FIG. 19 on the medial side of the shoe. Once again the user may tighten the shoe by releasing the hook and loop fastening surface sets 162 and 182, tightening the rear adjustment straps 152 and 172 thereby drawing the remaining straps tightly over the top of the shoe to secure it firmly to the foot.

Figure 20:
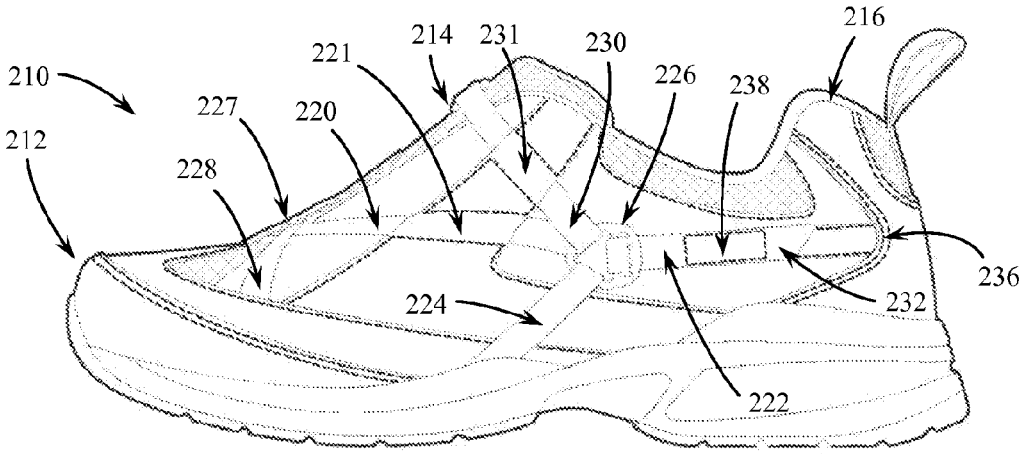
FIG. 20 is a side plan view of the lateral side of a shoe incorporating a modified ninth preferred embodiment of the present invention utilizing a double pull system with a two by four fixed attachment point structure.
Figure 21:
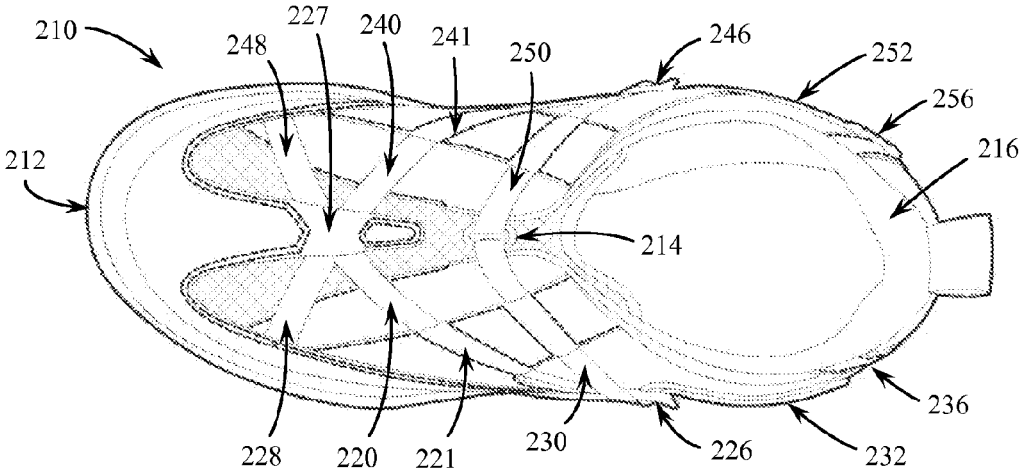
FIG. 21 is a top plan view of the shoe shown in FIG. 18 incorporating the modified ninth preferred embodiment of the present invention utilizing a double pull system with a two by four fixed attachment point structure.
Figure 22:
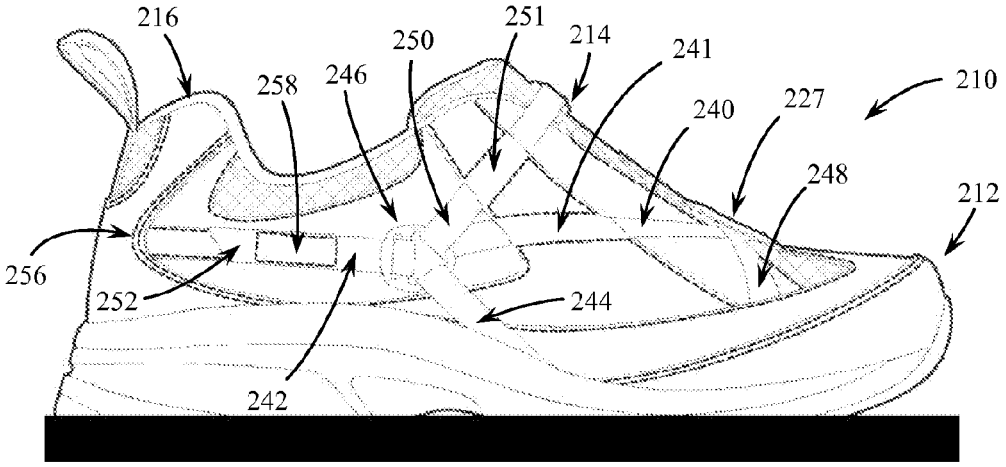
FIG. 22 is a side plan view of the medial side of the shoe shown in FIG. 18 incorporating the modified ninth preferred embodiment of the present invention utilizing a double pull system with a two by four fixed attachment point structure.
Figure 23:
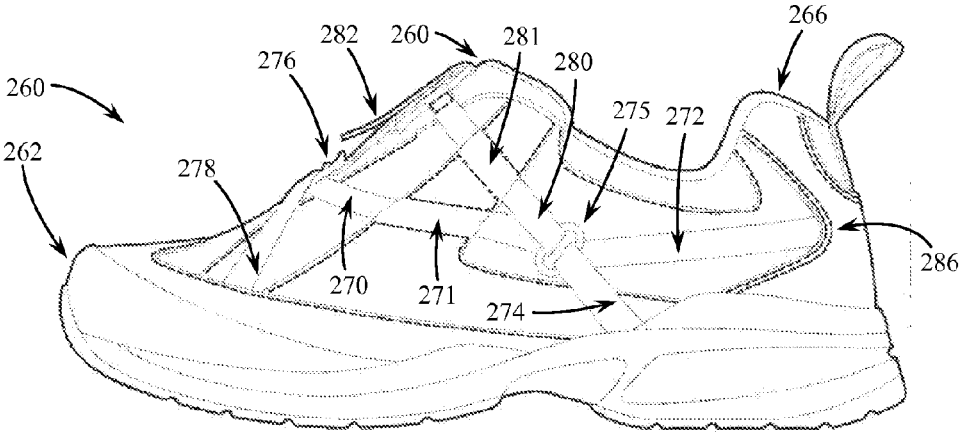
FIG. 23 is a side plan view of the lateral side of a shoe incorporating a tenth preferred embodiment of the present invention utilizing a single-pull double-sided system with a two by three fixed attachment point structure.

Reference is next made to FIGS. 20-22 for a description of a modified version of the ninth preferred embodiment of the present invention utilizing a double pull system with a two by four fixed attachment point structure. Once again, the double pull system shown provides a means for tightening the shoe on either or both of the medial and lateral sides. In fulfillment of the objectives of the present invention the lateral side of the shoe may be initially adjusted and then may remain fixed in adjustment while the user loosens and tightens the shoe through the medial adjustment means. Alternately, the user may adjust both sides of the shoe with each use of the shoe, fitting it to the foot in a customized manner each time.

The modification shown in FIGS. 20-22 involves the orientation and attachment of adjustable strap components 222 and 242 which extend from fixed positions 236 and 256 incorporated into heel region 216, forward to tri-buckle 226 and 246 respectively where they are folded back onto themselves through the buckle to their respective end points 232 and 252 where they adhere onto themselves with hook and loop attachment surfaces 238 and 258.

The balance of the components in this modified version of the ninth preferred embodiment shown in FIGS. 20-22 are essentially the same as those shown in FIGS. 17-19. Tri-buckle components 226 and 246 are distinct in structure from the same component in the unmodified version due to the sliding connection of the adjustment strap to the tri-buckle component in the modified version. An example of this tri-buckle structure is shown more clearly in FIG. 28. Once again the user may tighten the shoe by releasing the hook and loop fastening surfaces 238 and 258, tightening the rear adjustment straps 222 and 242 thereby drawing the remaining straps tightly over the top of the shoe to secure it firmly to the foot.

Figure 24:
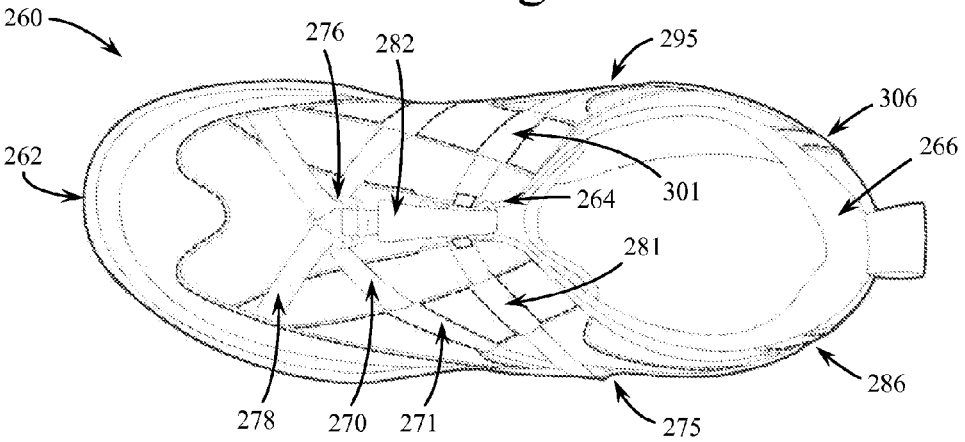
FIG. 24 is a top plan view of the shoe shown in FIG. 23 incorporating the tenth preferred embodiment of the present invention utilizing a single-pull double-sided system with a two by four fixed attachment point structure.
Figure 25:
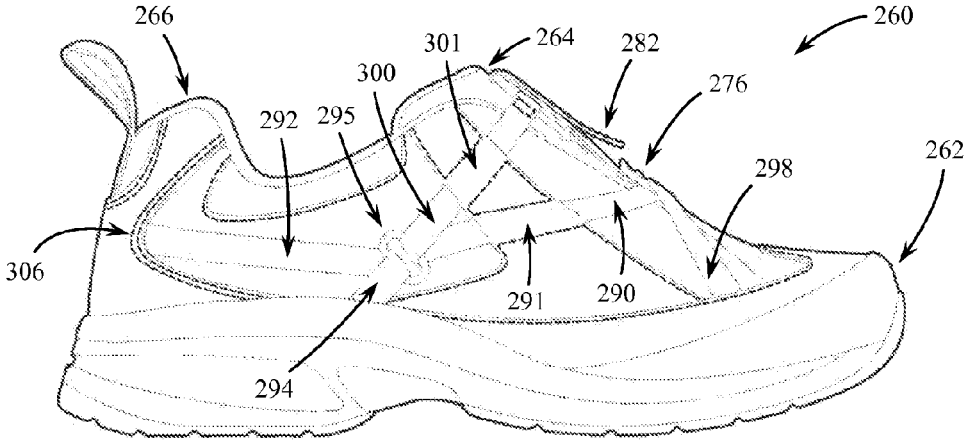
FIG. 25 is a side plan view of the medial side of the shoe shown in FIG. 23 incorporating the tenth preferred embodiment of the present invention utilizing a single-pull double-sided system with a two by three fixed attachment point structure.

A tenth preferred embodiment of the present invention is shown in FIGS. 23-25 and FIGS. 26A-26C. This tenth preferred embodiment incorporates some of the benefits of the crossover structure described above in conjunction with the ninth preferred embodiment but with a single-pull system rather than a double-pull system. Fit adjustment shoe 260 shown in FIG. 23 incorporates the same basic components on the forward (toe region) part of the shoe as in the ninth preferred embodiment. Strap component 278 extends from a fixed point in the toe region of the shoe to a centralized tri-buckle component 276 positioned along a center line at the peak of the shoe over the front region above the toe portion. Strap component 270 then turns back towards the same side of the shoe (the lateral side in this case) through retention channel 271 to a simple reversing loop component 275. Strap component 280 the returns towards the top of the shoe through retention channel 281 to a point of looped attachment on an orthogonal centering buckle component (shown in detail in FIG. 27) that effectively floats in position in the middle of the top part of the shoe, held in position by a mirror image set of strap components on the medial side of the shoe. FIG. 25 shows these medial side components that form the mirror image of the lateral side components shown in FIG. 23. These include strap component 298 which extends to tri-buckle component 276 which then turns back to form strap component 290, passing through retention channel 291 to simple reversing loop 295 to form strap component 300, which passes through retention channel 301, and finally up to a fixed point of attachment on orthogonal centering buckle component 264 described in more detail below.

The rearward and downward straps for the tenth preferred embodiment of the present invention are fixed starting at heel endpoints 286 and 306. Strap components 272 and 292 extend forward (on the respective sides of the shoe) to reversing loops 275 and 295 which they pass through and are directed downward to points of attachment to form strap components 274 and 294 which are incorporated into the heel component of the shoe near the sole at the shoe mid-point. An adjustable strap component fits between the forward tri-buckle component 276 and the orthogonal centering buckle component 264 at the crest of the shoe. Strap component 282, which is described in more detail in FIGS. 26A and 26C, draws these two buckle components together and, in the process, tightens each of the straps associated with these buckles either through re-direction or through secure end connections.

Figure 26A:
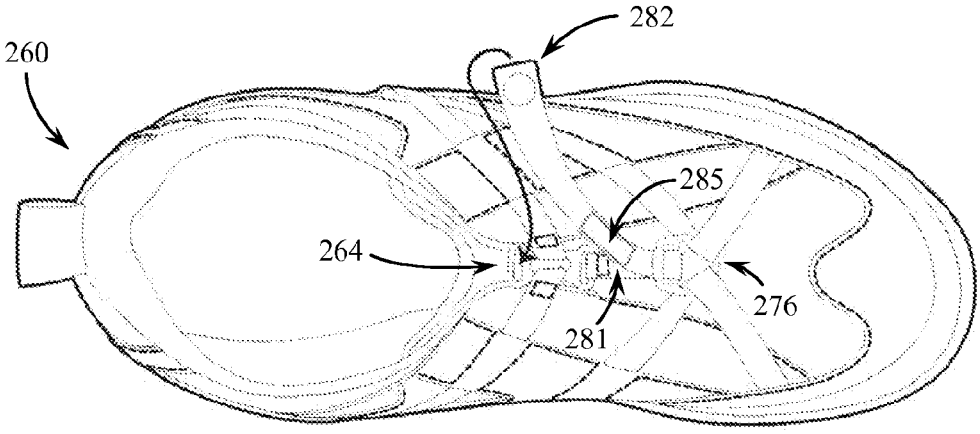
FIGS. 26A-26C are top plan views of the shoe shown in FIG. 23 incorporating the tenth preferred embodiment of the present invention showing the sequential manner of tightening and securing the single-pull double-sided system.
Figure 26B:
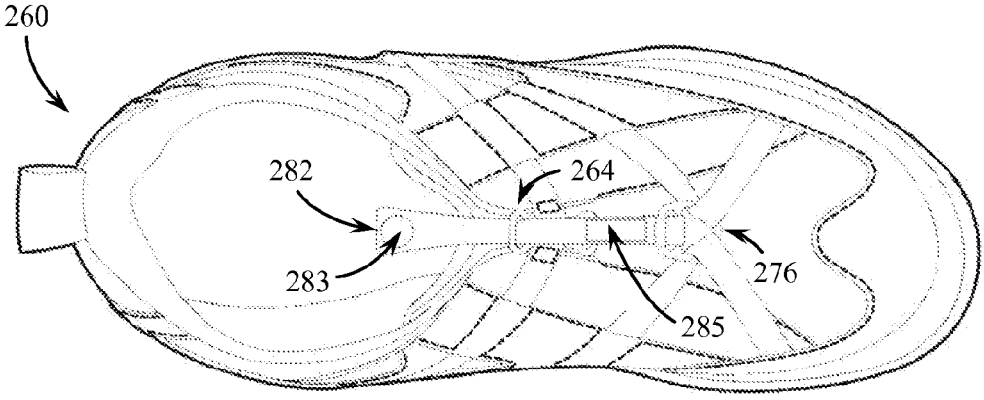
Figure 26C:
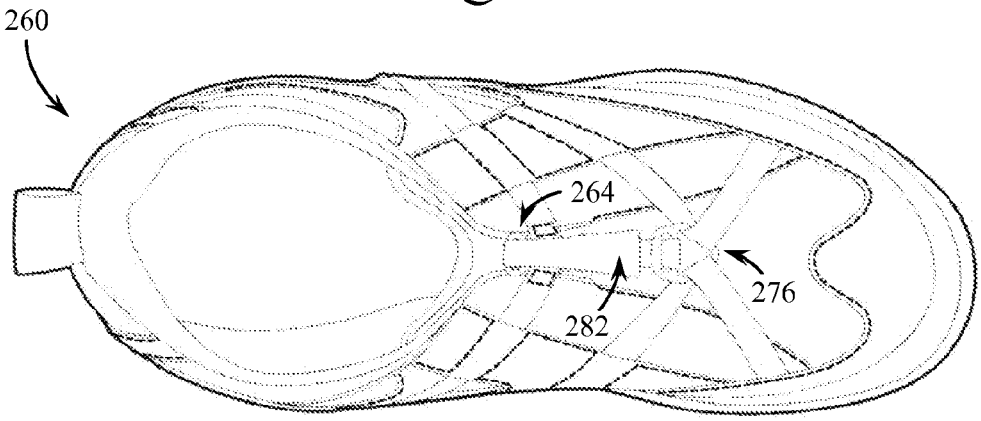

Reference is next made to FIGS. 26A-26C for a brief description of the manner in which tightening strap 282 is used to draw the strap system of the tenth preferred embodiment together. In FIG. 26A, adjustment strap 282 is seen to extend from a first fixed point of attachment on orthogonal centering buckle component 264 down to tri-buckle component 276 where it passes through a typical buckle structure to fold back on itself and cover over a portion of orthogonal centering buckle component 264. The end of strap 282 then passes through the open aperture of orthogonal centering buckle component 264 downward into the orientation shown in FIG. 26B. The end of strap component 282 may then be turned back on itself again (as shown in FIG. 26C) whereby hook and loop surfaces 283 and 285 meet to retain the end of strap component 282 in a closed and tightened configuration. Once again, this process draws the straps that pass through tri-buckle component 276 upward and together, while at the same time drawing the tri-buckle towards orthogonal centering buckle 264 in a manner that draws all of the straps together to tighten the shoe to fit snugly.

Figure 27:
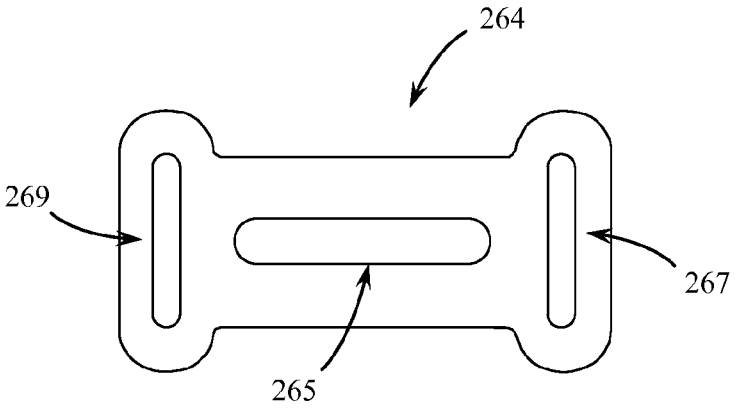
FIG. 27 is a detailed plan view of the orthogonal centering buckle component used in the tenth preferred embodiment as in FIGS. 23-25 & FIGS. 26A-26C.

As indicated above, FIG. 27 is a detailed plan view of the orthogonal centering buckle component 264 used in the tenth preferred embodiment of the present invention described above. Centering buckle component 264 defines three apertures 265, 267, and 269. Centering aperture 265 is wide enough to receive and retain two straps, one from each side of the shoe as shown in FIG. 24. These strap components fixed through centering aperture 265 do not slide through orthogonal centering buckle component 264, but hold the centering buckle along the top ridge line of the shoe. In contrast, apertures 267 and 269 serve as points to allow the sliding attachment and fixed retention of strap component 282 as it extends between orthogonal centering buckle 264 and tri-buckle component 276 (again, see FIG. 26A, for example). One end of strap 282 is fixed in position in aperture 267 from which it extends down to, and reverses direction through, tri-buckle component 276. Strap 282 then passes down through aperture 269 in centering buckle component 264, where it is again folded back on itself after being tightened within the two buckle components to a point where the hook and loop surfaces are appropriately positioned to retain the strap in a tightened configuration.

Figure 28:
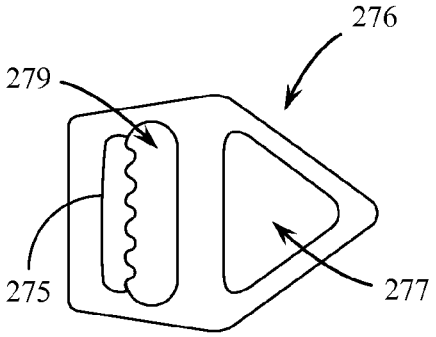
FIG. 28 is a detailed plan view of the tri-buckle adjustment component used in the ninth preferred embodiment of the present invention shown in FIGS. 20-22 and in the tenth preferred embodiment of the present invention shown in FIGS. 23-25 and FIGS. 26A-26C.

FIG. 28 provides a first example of a configuration of tri-buckle component 276 as used in the tenth preferred embodiment of the present invention. Tri-buckle component 276 incorporates a triangular aperture 277 which allows for three separate straps to pass through in a sliding or fixed manner. A second aperture 279 is positioned adjacent grip edge 275 in a manner that allows tightening strap component 282 to pass through the adjacent one of the three sides of the triangular aperture 277 in tri-buckle component 276 (as described above) and to tighten in the direction of orthogonal centering buckle 264.

In the manner described above, the single pull fit adjustment system of the tenth preferred embodiment of the present invention utilizes two unique buckle configurations that are drawn together, and in the process draw together the various fixed strap components attached to the balance of the shoe in a manner that tightens the entire strap system over and around the shoe to a center line and center point over a mid-section of the shoe.

Figure 29:
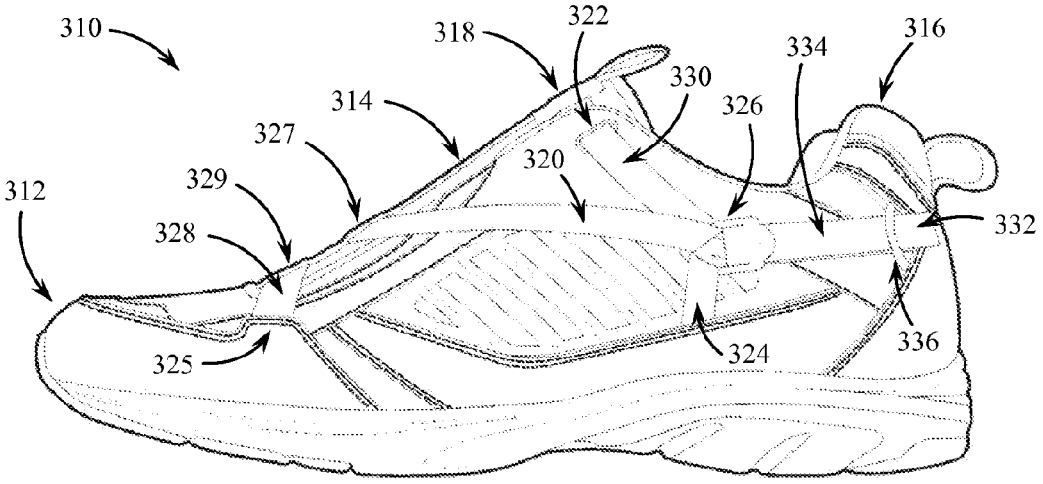
FIG. 29 is a side plan view of the medial side of a shoe incorporating an eleventh preferred embodiment of the present invention utilizing a single-pull system with a three fixed attachment point structure.
Figure 30:
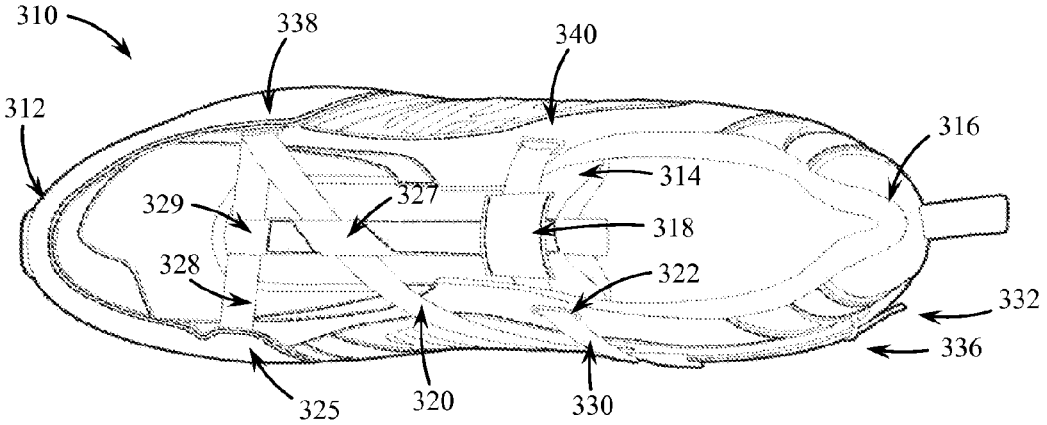
FIG. 30 is a top plan view of the shoe shown in FIG. 29 incorporating the eleventh preferred embodiment of the present invention utilizing a single-pull system with a three fixed attachment point structure.
Figure 31:
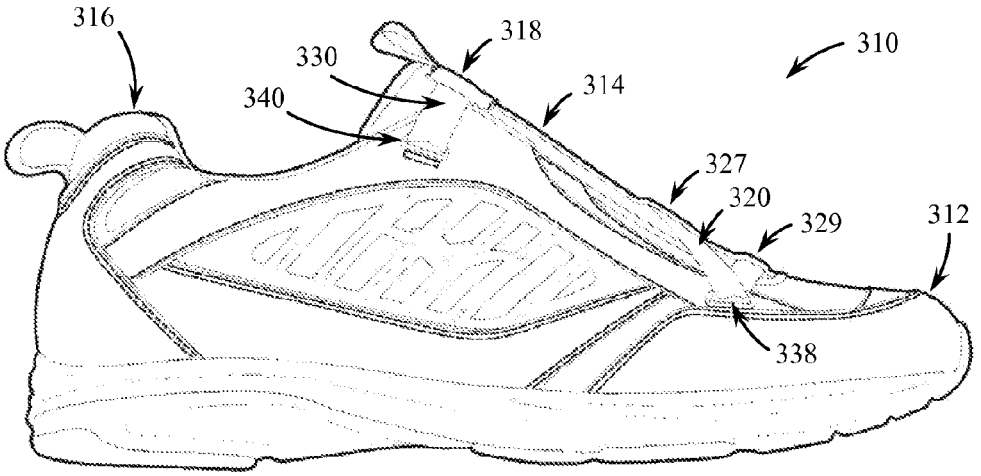
FIG. 31 is a side plan view of the lateral side of the shoe shown in FIG. 29 incorporating the eleventh preferred embodiment of the present invention utilizing a single-pull system with a three fixed attachment point structure.

Reference is next made to FIGS. 29-31 for a description of an eleventh preferred embodiment of the present invention, utilizing a single pull system with a three fixed attachment point structure. This single pull system provides a medial side adjustment strap that draws upon a tri-buckle component similar to that shown in conjunction with the ninth and tenth preferred embodiments of the present invention described above. In FIG. 29, fit adjustment shoe 310 is shown to include toe region 312, shoe tongue component 314, and shoe heel region 316. Forward adjustment strap 328 is positioned as shown, extending across the top front of the shoe from forward strap toe region attachment point 325. Forward adjustment strap 328 extends through retention channel 329 positioned on the lowest exposed portion of the tongue of the shoe. Strap 328 thereafter extends through and reverses direction in fixed reversing loop 338 positioned on the lateral side of shoe 310. Strap component 320 then extends through retention channel 327, again positioned on a section of the tongue of the shoe, to a point further back along the medial side of the shoe to tri-buckle component 326. The strap then reverses direction to form strap component 330 which extends up through aperture 322 in the upper side of the shoe and thereafter extends through retention channel 318 positioned across the top of the tongue of the shoe. Strap 330 then terminates by looped attachment to fixed retention loop 340 positioned on the upper lateral side of shoe 310 (see FIGS. 30 & 31). Tri-buckle 326 is held in its vertical position by way of fixed strap 324 which extends from tri-buckle component 326 down to a fixed point of attachment on the medial side of the shoe above or at the sole.

The adjustable component of the system of the eleventh preferred embodiment of the present invention is found in the rearward directed strap 334. This rearward strap extends from a fixed point on the rear of the shoe in the heel region 316 forward to tri-buckle adjustment component 326, where it is directed through the rearward pair of retention surfaces on tri-buckle component 326 as described above. The end tab 332 of adjustment strap 334 is slipped under retention loop 336 positioned on heel region 316 of the shoe. Hook and loop surfaces internal to the adjustment strap 334 retain the strap in position once adjusted in a manner similar to the previous embodiments described above.

Figure 32:
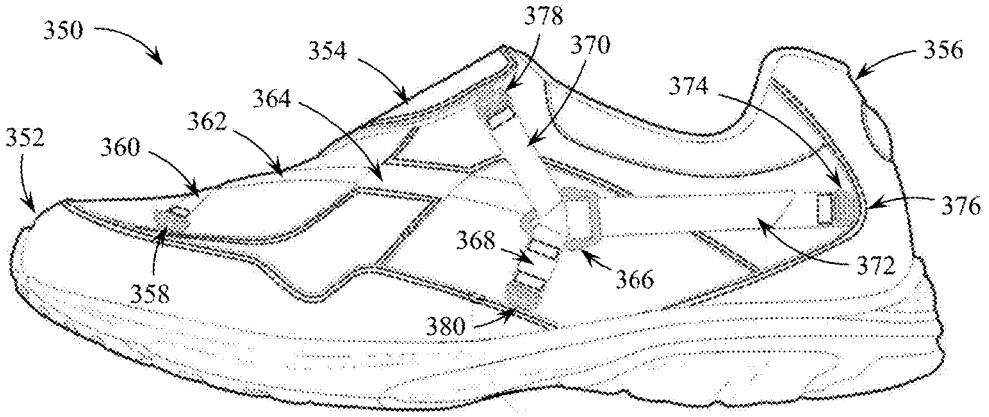
FIG. 32 is a side plan view of the medial side of a shoe incorporating a twelfth preferred embodiment of the present invention utilizing a four "fixed" attachment point structure similar to that shown in FIGS. 1 & 2, but incorporating user replaceable strap components.
Figure 33A:
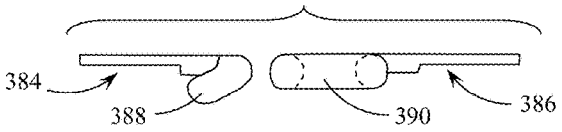
FIGS. 33A-33C are detailed side and top plan views of the releasable connector structure used in the twelfth preferred embodiment of the present invention shown in FIG. 32.
Figure 33B:
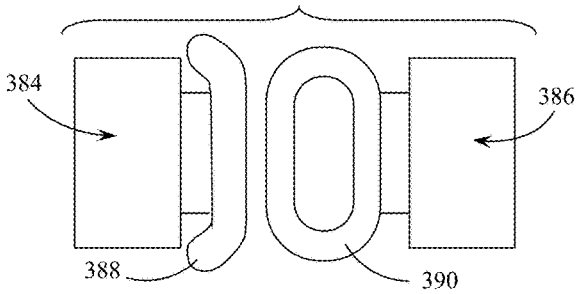
Figure 33C:
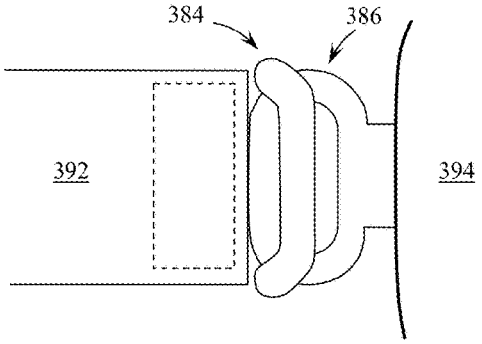

FIG. 32 is a side plan view of the medial side of a shoe incorporating a twelfth preferred embodiment of the present invention utilizing a four fixed attachment point structure similar in some respects to the embodiment shown in FIGS. 1 & 2, but incorporating user replaceable strap components in place of the fixed (sewn in) strap components. The specific structure of the removable connector components are shown in FIGS. 33A-33C. This twelfth preferred embodiment of the present invention utilizes a first strap having component portions 360, 362, and 370 that together extend from a fixed point of attachment 358 at the toe region 352 of fit adjustment shoe 350 across the shoe to a reversing loop, and then back through a retention channel 364 to a reversing orientation within tri-buckle component 366. The second end of the strap component is fixed to attachment point 378 near the top of the shoe on the crown 354 of the shoe upper. A short length of strap 368 extends from a fixed point 380 at the mid-base of the shoe up to one of the loop attachment points on tri-buckle component 366. An adjustable strap component 372 is positioned to the rear on the medial side of the shoe connecting a fixed point 376 in the heel region 356 to tri-buckle component 366, folding back on itself in a manner similar to that described above, and retained in position with matching hook and loop surfaces.

Each of the "fixed" points of attachment shown in the embodiment of FIG. 32, utilize removable or releasable connector structures as shown in detail in FIGS. 33A-33C. FIG. 33A is a detailed side assembly view of the two mating components that allow the user to release a particular strap component from the shoe. This two part releasable connector structure comprises a first horned hook component 384 having two horn extensions 388 that may be insertable through and retained within the loop component 386 which defines a closed rigid loop 390. The manner of attaching these two components is seen in FIG. 33C. In each instance, the loop component 390 is integrated into some part of the shoe 394, while the horned hook component 384 is integrated into a strap component 392.

The use of these releasable connector structures in the twelfth preferred embodiment of the present invention allows the user to alter the color or design character of the strap for ornamental purposes. Alternately, these releasable connector structures permit the replacement of a strap after a period of time when wear may have degraded the sliding surfaces of the strap material and/or the hook and loop surfaces used to keep the adjustment strap in place.

Figure 34:
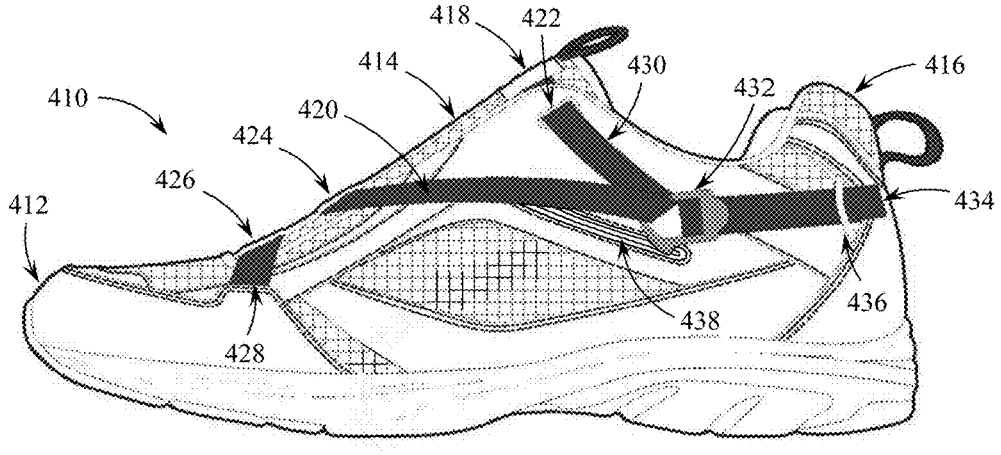
FIG. 34 is a side plan view of the medial side of a shoe incorporating a thirteenth preferred embodiment of the present invention utilizing a strap hub slidingly captive in a slide groove fixed on the side of the shoe.

FIG. 34 is a side plan view of the medial side of a shoe incorporating a thirteenth preferred embodiment of the present invention utilizing a strap hub slidingly captive in a slide groove fixed on the side of the shoe. Fit adjustment shoe 410 utilizes an arrangement similar to that shown in FIGS. 29-30 but substitutes a movable buckle component 432 captively sliding in slide groove 438, in place of the fixed lower strap shown in the eleventh preferred embodiment. Adjustment is made in a manner similar to that in the eleventh preferred embodiment with the vertical alignment of the buckle component being maintained by its position within the slide groove and the horizontal position of the buckle component varying according to the tightness of the adjustable strap. The orientation of the slide groove 438 facilitates the opening and closing of the shoe.

Figure 35A:
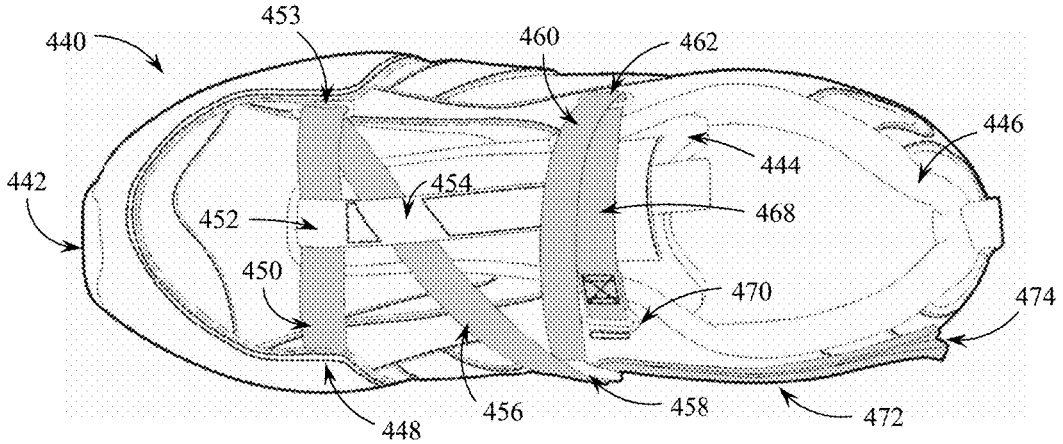
FIGS. 35A & 35B are a top plan view and a detail view, respectively of a shoe incorporating a fourteenth preferred embodiment of the present invention utilizing a single-pull system with a four fixed attachment point multi-crossover structure.
Figure 35B:
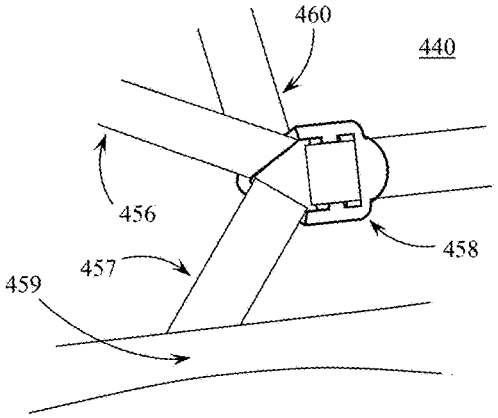

FIGS. 35A & 35B are a top plan view and a detail view, respectively of a shoe incorporating a fourteenth preferred embodiment of the present invention utilizing a single-pull system with a four fixed attachment point multi-crossover structure. Fit adjustment shoe 440 is structured in most respects like the embodiment shown in FIG. 30 with the exception of the terminal end of strap portion 460. Instead of terminating at attachment aperture 462, the strap turns back across the shoe to provide a further section to draw the shoe closed. Strap 468 now terminates back on the medial side of the shoe at fixed attachment point 470. The balance of the components shown in FIGS. 35A & 35B operate in the manner described above with respect to the eleventh preferred embodiment. In FIG. 35A fit adjustment shoe 440 is shown to include toe region 442, shoe tongue component 444, and shoe heel region 446. Forward adjustment strap 450 is positioned as shown, extending across the top front of the shoe from forward strap toe region attachment point 448. Forward adjustment strap 450 extends through retention channel 452 positioned on the lowest exposed portion of the tongue of the shoe. Strap 450 thereafter extends through and reverses direction in fixed reversing loop 453 positioned on the lateral side of shoe 440. Strap component 456 then extends through retention channel 454, again positioned on a section of the tongue of the shoe, to a point further back along the medial side of the shoe to tri-buckle component 458 (see detail in FIG. 35B). The strap then reverses direction to form strap component 460 which extends across the top of the tongue of the shoe to attachment aperture 462 where it turns back as described above. Tri-buckle 458 is held in its vertical position by way of fixed strap 457 (see detail in FIG. 35B) which extends from tri-buckle component 458 down to a fixed point of attachment 459 on the medial side of the shoe 440 above or at the sole. The adjustable component of the system of the fourteenth preferred embodiment of the present invention is found in the rearward directed adjustment strap 472. This rearward strap extends from a fixed point 474 on the rear of the shoe in the heel region 446 forward to tri-buckle component 458, where it is directed through the rearward pair of retention surfaces on tri-buckle component 458 as described above. The end tab of adjustment strap 472 may optionally be slipped under a retention loop (of the type shown as retention loop 336 in FIG. 29 referenced above) positioned on heel region 446 of the shoe. Hook and loop surfaces internal to the adjustment strap 472 retain the strap in position once adjusted in a manner similar to the previous embodiments described above. In addition, each of the "fixed" points of attachment shown in the embodiment of FIG. 35A may optionally utilize the removable or releasable structures shown in detail in FIGS. 33A-33C.

Figure 36A:
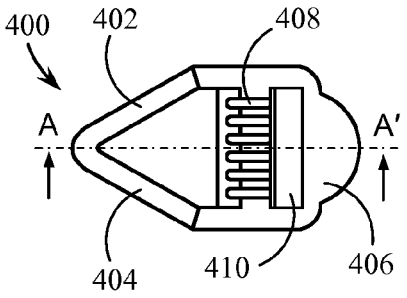
FIGS. 36A-36E are detailed views (top plan, side plan, bottom plan, and cross sectional) of an alternate preferred embodiment of the tri-buckle component used in conjunction with a number of the preferred embodiments of the present invention.
Figure 36D:
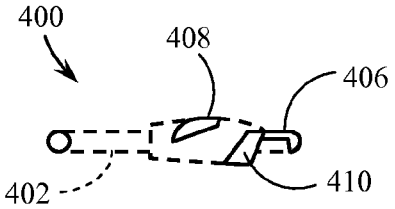
Figure 36B:
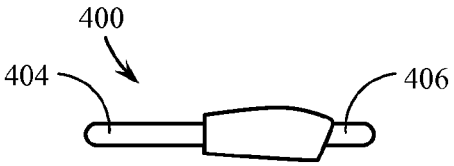
Figure 36E:
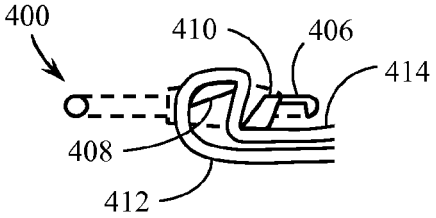
Figure 36C:
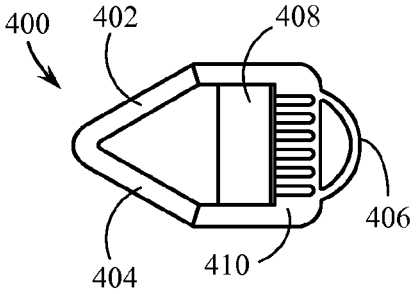

FIGS. 36A-36E are detailed views (top plan, side plan, bottom plan, and cross sectional) of an alternate preferred embodiment of the tri-buckle component used in conjunction with a number of the preferred embodiments of the system of the present invention. This structure for tri-buckle component 400 includes a standard turn-back buckle section made up of end 406 and grip surface bars 408 and 410. Integrated with this standard buckle structure are tri-buckle bars 402 and 404 which serve to allow three straps to meet and connect together at the tri-buckle, one through the standard buckle side and two across the triangular shaped bars 402 and 404. The manner in which a strap is fed through the standard buckle side of the tri-buckle is shown in FIG. 36E with shoe-side strap portion 412 positioned beneath strap portion 414 as shown.

Figure 37:
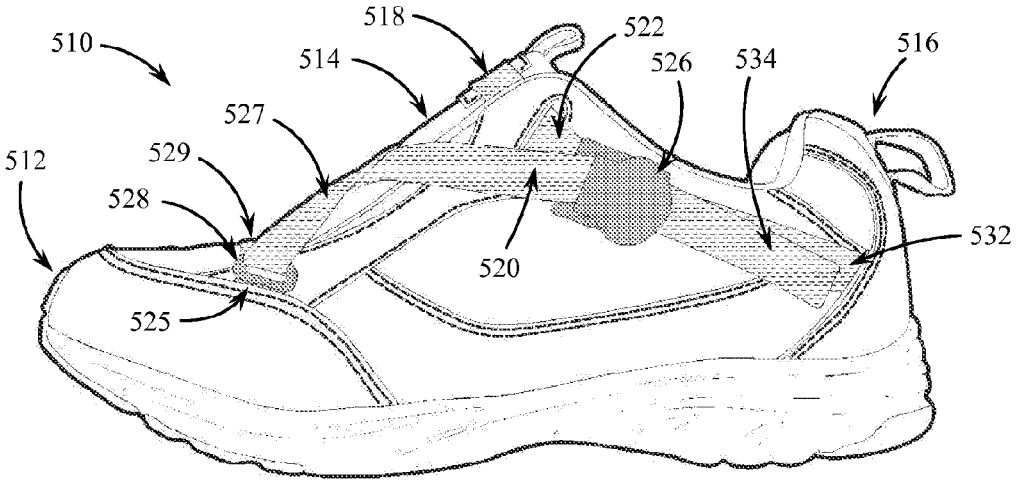
FIG. 37 is a side plan view of the medial side of a shoe incorporating a fifteenth preferred embodiment of the present invention utilizing a single-pull system with a three fixed and one floating attachment point structure.
Figure 38:
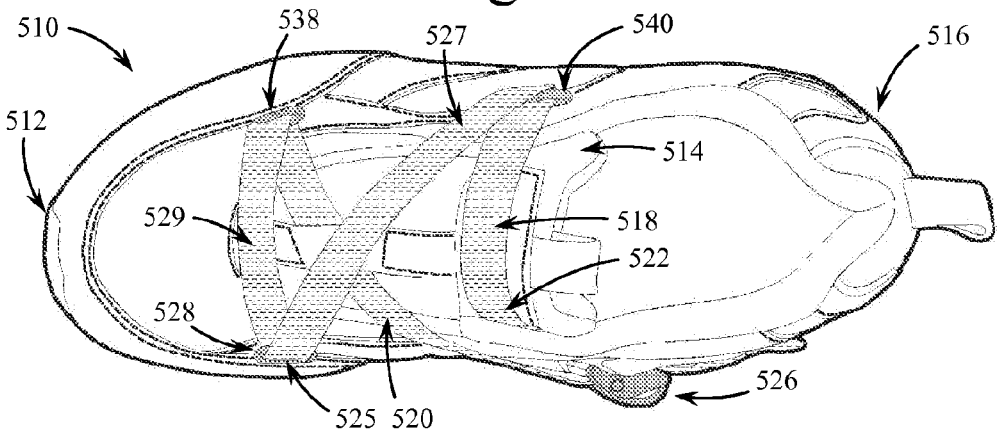
FIG. 38 is a top plan view of the shoe shown in FIG. 37 incorporating the fifteenth preferred embodiment of the present invention utilizing a single-pull system with a three fixed and one floating attachment point structure.
Figure 39:
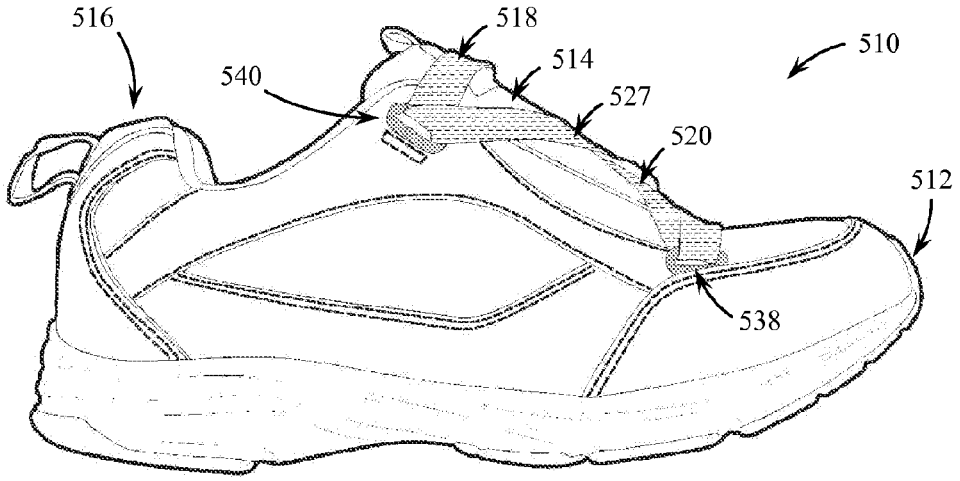
FIG. 39 is a side plan view of the lateral side of the shoe shown in FIG. 37 incorporating the fifteenth preferred embodiment of the present invention utilizing a single-pull system with a three fixed and one floating attachment point structure.

Reference is next made to FIGS. 37-39 for a description of a fifteenth preferred embodiment of the present invention, utilizing a single pull system with a three fixed and one floating attachment point structure. This single pull system provides a medial side adjustment strap that draws upon a buckle component similar to that shown in conjunction with previously described preferred embodiments of the present invention. In FIG. 37, fit adjustment shoe 510 is shown to include toe region 512, shoe tongue component 514, and shoe heel region 516. Strap 529 thereafter extends through and reverses direction in fixed reversing loop 538 positioned on the lateral side of shoe 510. Strap component 520 then extends to a point further back along the medial side of the shoe to buckle component 526. The strap then reverses direction to form strap component 522 and then 518 which extends through aperture 540 in the lateral side of the shoe. Strap 527 then returns to fixed retention loop 525.

The adjustable component of the "X" structured system of the fifteenth preferred embodiment of the present invention is found in the rearward directed strap 534. This rearward strap extends from a fixed point on the rear of the shoe in the heel region 516 forward to buckle adjustment component 526, where it is directed through the rearward pair of retention surfaces as described above.

Reference is finally made to FIGS. 40A-40E for a description of certain functional variations on the fixed/siding attachment system principals of the present invention. FIGS. 40A-40E are schematic diagrams representing such variations based in part on the various preferred embodiments described above. Each of the functional schematic diagrams presented in FIGS. 40A-40D include at least three fixed strap points (represented by solid black circles) at the end points of the straps, as well as at least one (and generally only one) sliding removable strap section indicated by an arrow pointing in the direction the user would pull the strap end to tighten and adjust the shoe to the foot. In addition, each of the diagrams presented in FIGS. 40A-40D provides two open circles, a first representing a sliding anchor point fixed on the top front of the shoe (basically as described above with the front shoe mid-anchor loop) as well as a centralized floating sliding junction provided by the variously described embodiments involving tri-buckles and other nylon rings or triangles.

Figure 40A:
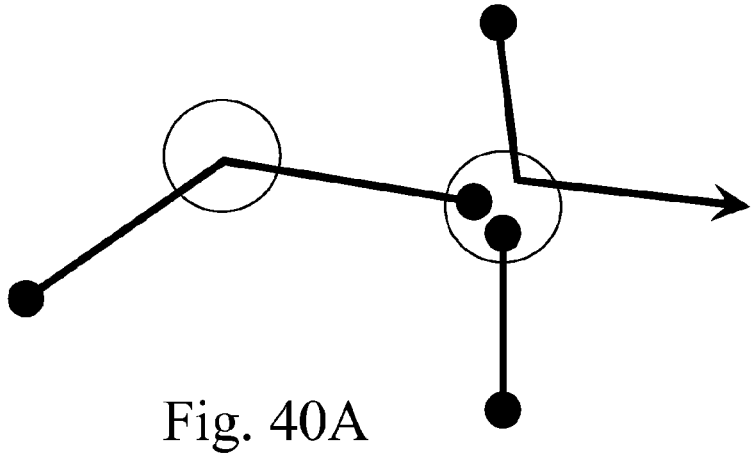
FIGS. 40A-40E are schematic diagrams providing functional variations on the fixed/sliding attachment system principals of the present invention.

FIG. 40A describes a functional system with fixed straps attached between the front toe area of the shoe (to the left in the diagram) and to the central lower sole area of the shoe (centered in the diagram). Each of these two fixed straps are connected to the floating central loop by way of a fixed non-sliding attachment. The third strap is fixed at a central upper point on the shoe (typically to the crossover flap on the shoe) and slides through the center adjustment loop as the strap is pulled towards the back of the shoe. This basic functional diagram describes in principal the various force vectors and adjustment links that the systems of the present invention are intended to vary. The means for securing the sliding strap (the arrowed strap) could be any of the mechanisms described above, including the Velcro® material on the side of the shoe, such as in FIG. 14 or any other latching mechanism directed back onto an existing strap.

Figure 40B:
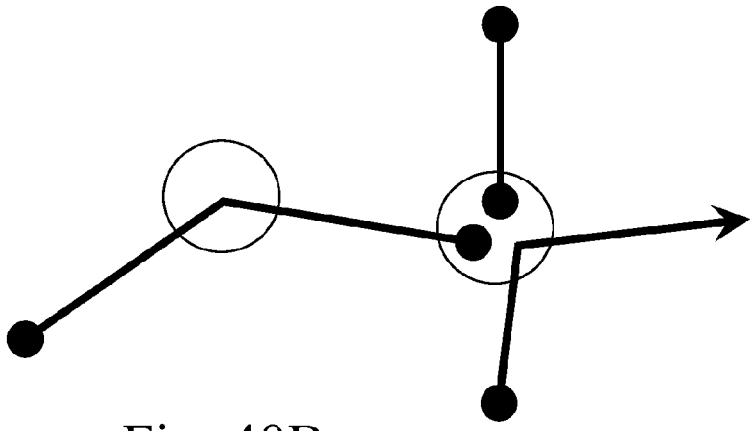
Figure 40C:
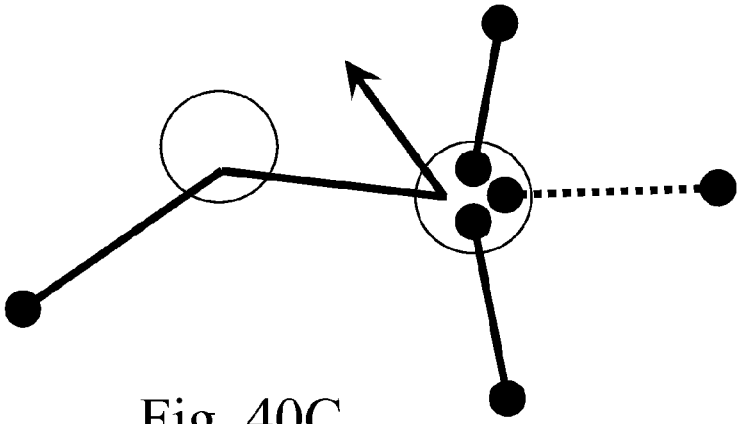

FIGS. 40B and 40C provide alternate mechanisms for situating the sliding, variable length strap. In FIG. 40B the sliding strap originates from the base of the shoe rather than the top, and in FIG. 40C the sliding strap originates from the front of the shoe. FIG. 40C also discloses the optional fixed strap attachment between the central floating adjustment loop and the rear heel region of the shoe.

Figure 40D:
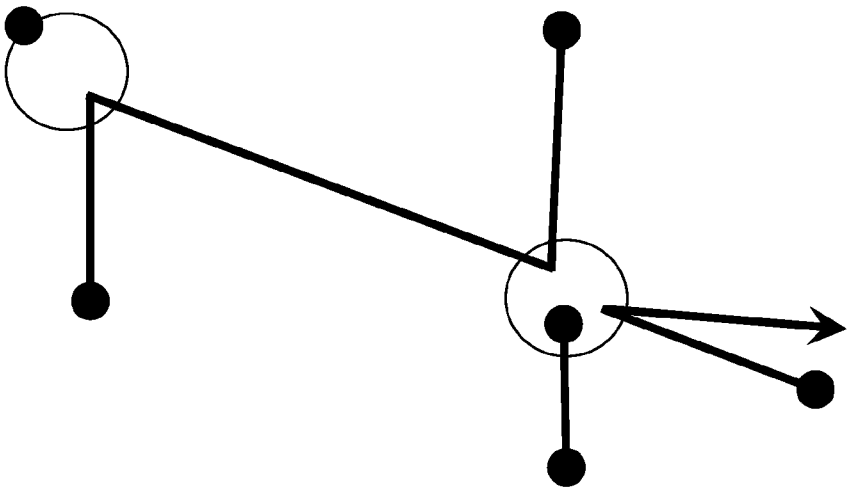
Figure 40E:
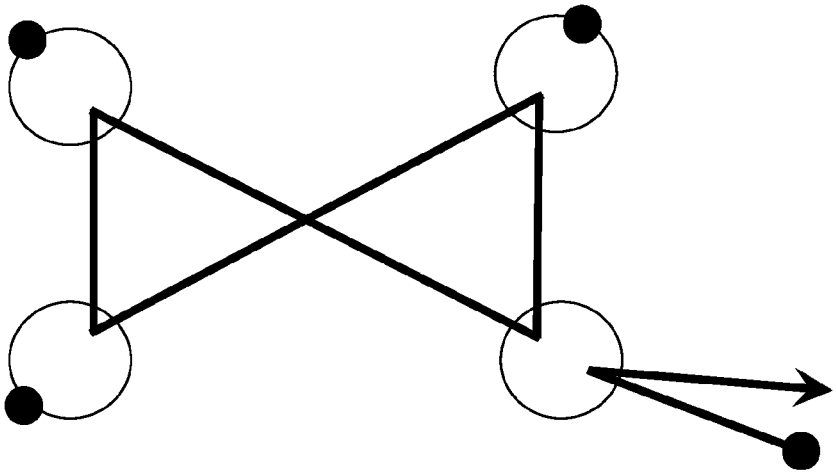

FIG. 40D provides the functional structure for the basic "Z" strap system of the present invention, while FIG. 40E provides the functional structure for the basic "X" strap system of the present invention.

Although the present invention has been described in conjunction with a number of preferred embodiments, those skilled in the art will recognize that the fundamental components of the system may be utilized in combination with components from other preferred embodiments described. Variations on the specific placement of the fixed ends of each of the straps, as well as the mid-anchor loops described are anticipated. The goal of the present invention that extends across each of the embodiments, is to provide strap tension towards a central point on the medial side (or the lateral side, in one instance) of the side of the shoe, so as to effect both a horizontal and a vertical tightening of the shoe components around the user's foot. The key elements include the forward adjustment strap structure, which serves to draw both a horizontal tension from the toe region of the show to the mid-section, and an across the shoe tension such as might typically be accomplished with a plurality of shoe lacings. A variety of rear and lower adjustment straps serve to draw the heel region of the shoe, the top upper region of the shoe, and the sole region together, again directing tension vectors towards a center point where a floating buckle arrangement is configured. Those variations with respect to fixed attachment points, buckle placement points, and adjustment strip placement are considered to fall within the scope of the present invention.

The invention claimed is:

1. A system for securing a shoe to a foot utilizing a single-pull fit adjustment motion, the shoe having a length and a width, the system comprising:

(a) a buckle component positioned in a generally centered location on a first side of the shoe;

(b) a first strap extending from a first attachment point on a toe portion of a second side of the shoe, to the buckle component on the first side of the shoe;

(c) a second strap extending from a second attachment point on a middle portion of the first side of the shoe to the buckle component; and (d) a variable length strap extending longitudinally from a third attachment point on a back upright heel portion of the first side of the shoe, slidingly through the buckle component, to an adjustment mechanism fixed on the first side of the shoe, the adjustment mechanism alternately releasing and securing the variable length strap along its length, the variable length strap longitudinally aligned and parallel with the length of the shoe.

2. The system of claim 1 wherein the shoe has a medial side and a lateral side and the first side of the shoe is the medial side and the second side of the shoe is the lateral side.

3. The system of claim 1 wherein the first strap further extends slidingly through the buckle component to a fourth attachment point on the second side of the shoe.

4. The system of claim 3 wherein the shoe has a tongue, the tongue comprising a plurality of retention channels, the retention channels slidingly engaging the first strap at points where the first strap crosses over the tongue.

5. The system of claim 3 wherein the first, second, third, and fourth attachment points each comprise a removable connector component having a first portion fixed to the shoe and a second portion fixed to the end of the associated strap.

6. The system of claim 1 wherein the shoe has a tongue, the tongue comprising a plurality of retention channels, the retention channels slidingly engaging the first strap at points where the first strap crosses over the tongue.

7. The system of claim 1 wherein the adjustment mechanism comprises hook and loop material surfaces positioned along the length of the variable length strap.

8. The system of claim 1 wherein the buckle component comprises a cinch buckle and the adjustment mechanism comprises frictional surfaces on the cinch buckle.

9. The system of claim 1 further comprising a retention loop positioned adjacent the third attachment point on the back upright heel portion of the first side of the shoe, the retention loop positioned to retain a non-fixed end of the variable length strap after the adjustment mechanism secures the variable length strap.

10. The system of claim 1 wherein the buckle component comprises a triangular ring.

11. The system of claim 1 wherein the buckle component is movable over the first side of the shoe.

12. The system of claim 1 wherein the first, second, and third attachment points each comprise a removable connector component having a first portion fixed to the shoe and a second portion fixed to the end of the associated strap.

* * * * *